US006430982B2

(12) United States Patent
Andrea et al.

(10) Patent No.: US 6,430,982 B2
(45) Date of Patent: Aug. 13, 2002

(54) COIL SPRING FORMING AND CONVEYING ASSEMBLY

(76) Inventors: Michael E. Andrea, 7412 5th Ave., Kenosha, WI (US) 53143; Stuart C. Hamill, 63B Sackville Street, Grey Lynn Aukland (NZ); Wayne D. Jaworski, 2551 S. 71st St., West Allis, WI (US) 53219; Horst F. Wentzek, 4750 83rd St., Kenosha, WI (US) 53142

( * ) Notice: Subject to any disclaimer, the term of this patent is extended or adjusted under 35 U.S.C. 154(b) by 0 days.

(21) Appl. No.: 09/753,936

(22) Filed: Jan. 3, 2001

Related U.S. Application Data

(63) Continuation of application No. 09/365,371, filed on Jul. 30, 1999, now abandoned, which is a continuation-in-part of application No. 09/005,346, filed on Jan. 9, 1998, now Pat. No. 5,950,473.

(60) Provisional application No. 60/057,213, filed on Aug. 29, 1997, and provisional application No. 60/120,832, filed on Feb. 19, 1999.

(51) Int. Cl.[7] ..... B21F 27/16

(52) U.S. Cl. ..... 72/134; 140/3 CA

(58) Field of Search ..... 72/138, 134; 140/3 CA

(56) References Cited

U.S. PATENT DOCUMENTS

| | | | | |
|---|---|---|---|---|
| 2,059,117 A | | 10/1936 | King et al. | |
| 3,205,915 A | * | 9/1965 | Kamp | 140/3 CA |
| 3,906,766 A | | 9/1975 | Sato | 72/12 |
| 4,014,371 A | | 3/1977 | Walker et al. | 140/3 |
| 4,111,241 A | | 9/1978 | Crown | 140/92.7 |
| 4,112,721 A | * | 9/1978 | Takase et al. | 72/138 |
| 4,413,659 A | | 11/1983 | Zangerle | 140/3 CA |
| 4,492,298 A | | 1/1985 | Zapletal et al. | 198/409 |
| 5,243,746 A | | 9/1993 | Shinichi | 29/173 |
| 5,477,893 A | | 12/1995 | Wentzek et al. | 140/101 |
| 5,579,810 A | | 12/1996 | Ramsey et al. | 140/3 CA |

FOREIGN PATENT DOCUMENTS

| | | | |
|---|---|---|---|
| DE | 29 46 656 C2 | 10/1985 | B21F/3/06 |
| DE | 43 23 009 A1 | 7/1992 | B21F/3/06 |
| EP | 0 044 464 A2 | 1/1982 | B21F/3/02 |
| EP | 0 369 173 A2 | 5/1990 | B21F/3/00 |
| FR | 2 238 546 | 2/1975 | B21F/3/00 |
| WO | WO00/47348 | 8/2000 | |

OTHER PUBLICATIONS

*Draht*, Jan. 1984, by Dr. H. Birkmann, pp. 18–21.

*Draht*, Sep. 1993, by Thomas Blum, Dietmar Sautter, Theo Tröster, pp. 504–514.

Brochure "Announcing the World's Fastest, Most Advanced Pocket Spring Technology", circulated by Elfex International Limited of Pickering, Ontario L1WZ9 Canada.

* cited by examiner

*Primary Examiner*—Lowell A. Larson
(74) *Attorney, Agent, or Firm*—Boyle, Fredrickson, Newholm, Stein & Gratz, S.C.

(57) ABSTRACT

Disclosed herein is a coil spring forming head which is periodically operative to at least partially form coil springs having a plurality of coils and which includes a wire feed advancing mechanism operative to feed the wire which is formed into coil springs, a pitch control mechanism operative to control the diameter of the coils of the coil springs being formed, a diameter control mechanism operative to control the pitch of the coils of the coil springs being formed, and a control including a storage area containing instructions for operation of the wire feed advancing mechanism, the pitch control mechanism, and the diameter control mechanism, a wire feed controller connected to the wire feed advancing mechanism to control operation thereof, a pitch controller connected to the pitch control mechanism to control operation thereof, a diameter controller connected the diameter control mechanism to control operation thereof, and a programmable switching device connected to the wire feed controller, to the pitch controller, and to the diameter controller and selectively connectable to the storage area to afford forwarding of selected instructions from the storage area to the wire feed controller, to the pitch controller, and to the diameter controller.

19 Claims, 15 Drawing Sheets

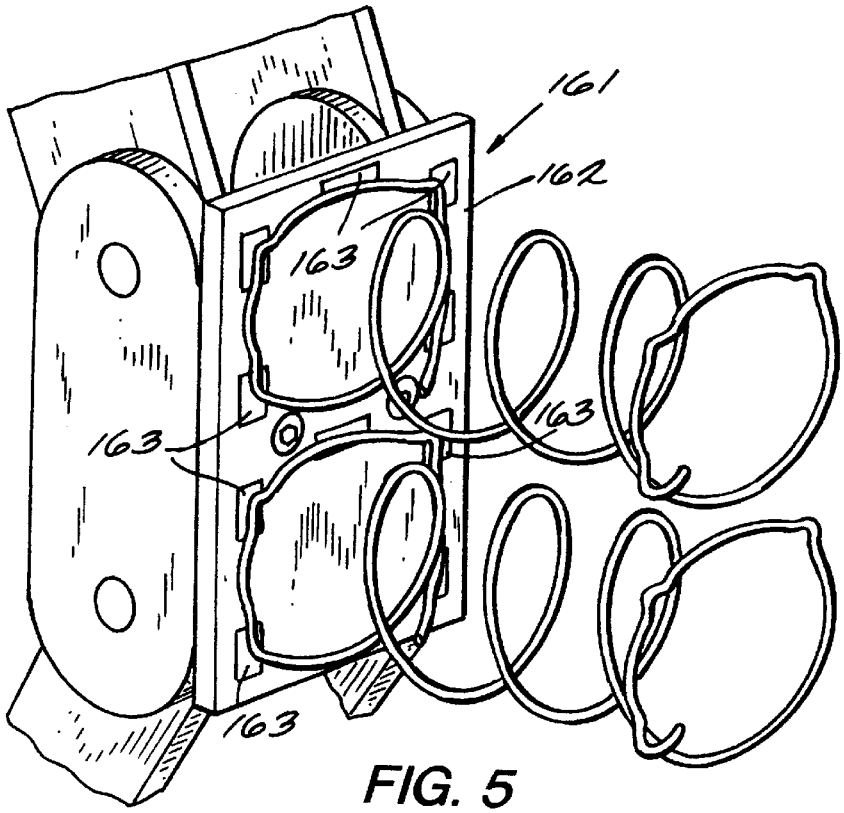
FIG. 5
FIG. 4
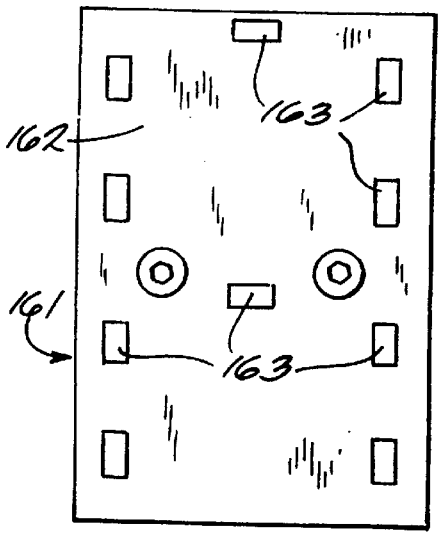
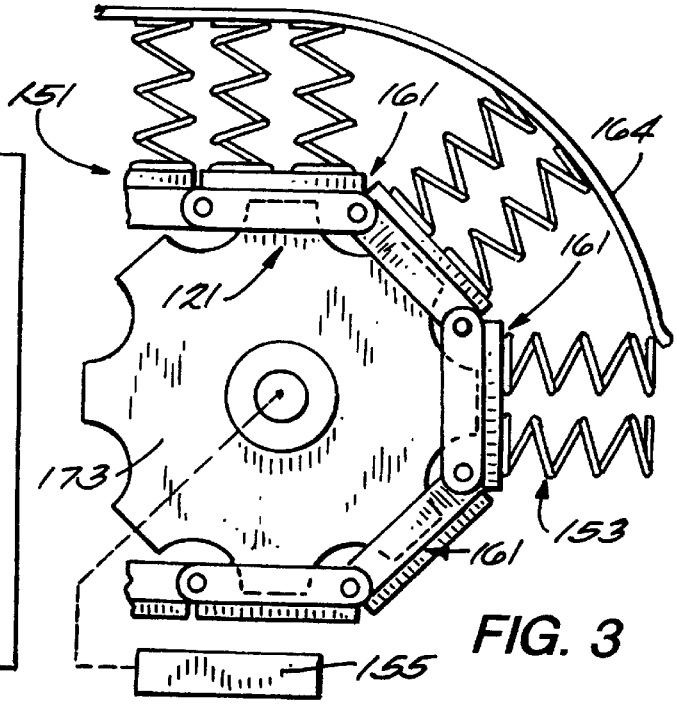
FIG. 3

COIL SPRING FORMING AND CONVEYING ASSEMBLY

RELATED APPLICATIONS

This application is a continuation of U.S. application Ser. No. 09/365,371 filed Jul. 30, 1999, now abandoned, which is a continuation-in-part of U.S. application Ser. No. 09/005,346 filed Jan. 9, 1998, now U.S. Pat. No. 5,950,473 issued Sep. 14, 1999, which is a continuation-in-part of U.S. Provisional Application Serial No. 60/057,213, filed Aug. 29, 1997. This application also claims priority of U.S. Provisional Application Serial No. 60/120,832, filed Feb. 19, 1999.

BACKGROUND OF THE INVENTION

The invention relates generally to machines for forming coil springs and delivering such coil springs to a coil spring assembling machine in which the coil springs are laced or otherwise connected together to form a coil spring assembly. In such combined machinery, a coil spring forming machine individually delivers the formed coiled springs to a transfer conveyor which, in turn, delivers the coil springs to a transfer apparatus which, in turn, delivers the coil springs to the coil spring assembling machine to form the coil spring assembly.

Attention is directed to the following U.S. Patents:

U.S. Pat. No. 4,014,371 (Walker) issued Mar. 29, 1977

U.S. Pat. No. 4,413,659 (Zangerle) issued Nov. 8, 1983

U.S. Pat. No. 4,492,298 (Zapletal et al.) issued Jan. 8, 1985

U.S. Pat. No. 5,477,893 (Wentzek et al.) issued Dec. 26, 1995

U.S. Pat. No. 5,579,810 (Ramsey et al.) issued Dec. 3, 1996

Attention is also directed to a prior brochure which is entitled "Announcing the World's Fastest, Most Advanced Pocket Spring Technology" and which was circulated by Elfex International Limited of Pickering, Ontario LlW1Z9 Canada.

SUMMARY OF THE INVENTION

The invention provides a coil spring forming machine and transfer conveyor assembly comprising a transfer conveyor operable through a succession of operational cycles and including an endless conveyor assembly arranged for periodic travel along a predetermined path and through a coil spring loading station, and a conveyor driving device drivingly connected to the conveyor assembly and operative, upon each energization thereof, to drive the conveyor assembly through one operational cycle thereof, a first coil spring forming machine located adjacent the predetermined path, operable through a succession of operational cycles to form coil springs, and, during a period of non-movement of the conveyor assembly, to load a coil spring on the conveyor assembly at the loading station, and including a first coil spring forming driving device operative, upon each energization thereof, to drive the first coil spring forming machine through one operational cycle thereof, a second coil spring forming machine located adjacent the predetermined path, operable through a succession of operational cycles to form coil springs, and, during a period of non-movement of the conveyor assembly, to load a coil spring on the conveyor assembly at the loading station, and including a second coil spring forming driving device operative, upon each energization thereof, to cause actuation of the second coil spring forming machine through one operational cycle thereof, and a control system operative to cause energization of the conveyor driving device in response to completion of one operational cycle of one of the first and second coil spring forming driving devices, and operative to cause energization of one of the first and second coil spring forming driving devices in response to completion of one operational cycle of the conveyor driving device.

The invention also provides a coil spring forming machine and transfer conveyor assembly comprising a transfer conveyor operable through a succession of operational cycles and including an endless conveyor assembly arranged for periodic travel along a predetermined path and for passage through a coil spring loading station, and a conveyor driving device drivingly connected to the conveyor assembly and operative, upon each energization thereof, to drive the conveyor assembly through one operational cycle thereof, a first coil spring forming machine located on one side of the predetermined path, operable through a succession of operational cycles to form a first coil spring, and, during a period of non-movement of the conveyor assembly, to load the first coil spring on the conveyor assembly in the loading station, and including a first coil spring forming driving device operative, upon each energization thereof, to drive the first coil spring forming machine through one operational cycle thereof, and a second coil spring forming machine located on the other side of the predetermined path, operable through a succession of operational cycles to form a second coil spring, and, during a period of non-movement of the conveyor assembly, to load the second coil spring on the conveyor assembly in the loading station, and including a second coil spring forming driving device operative, upon each energization thereof, to drive the second coil spring forming machine through one operational cycle thereof, and a control system operative to cause energization of the conveyor driving device through one operational cycle in response to completion of one operational cycle of both of the first and second coil spring forming driving devices, and operative to cause simultaneous energization of the first and second coil spring forming driving devices in response to completion of one operational cycle of the conveyor driving device.

The invention also provides a coil spring forming machine and transfer conveyor assembly comprising a transfer conveyor operable through a succession of operational cycles and including an endless conveyor assembly arranged for periodic travel along a predetermined path and for passage through a coil spring loading station, and a conveyor driving device drivingly connected to the conveyor assembly and operative, upon each energization thereof, to drive the conveyor assembly through one operational cycle thereof, a first coil spring forming machine located on one side of the predetermined path, operable through a succession of operational cycles to form a first coil spring, and, when one of the pallets is in the loading station and during a period of non-movement of the conveyor assembly, to load the first coil spring on the conveyor assembly in the loading station, and including a first coil spring forming driving device operative, upon each energization thereof, to drive the first coil spring forming machine through one operational cycle thereof, a second coil spring forming machine located on the other side of the predetermined path, operable through a succession of operational cycles to form a second coil spring, and, when the one pallet is in the loading station and during a period of non-movement of the conveyor assembly, to load the second coil spring on the conveyor assembly in the loading station, and including a second coil spring forming driving device operative, upon each energization thereof, to drive the second coil spring forming machine through one operational cycle thereof, and a control system operative to cause energization of the conveyor driving device through a first operational cycle in response to completion of one operational cycle of the first coil spring forming driving device, operative to cause energization of the second coil spring forming driving device in response to completion of the first operational cycle of the conveyor driving device, operative to cause energization of the conveyor driving device through a second operational cycle in response to completion of one operational cycle of the second coil spring forming driving device, and operative to cause energization of the first coil spring forming driving device in response to completion of the second operational cycle of the conveyor driving device.

The invention also provides a coil spring forming machine and transfer conveyor assembly comprising a transfer conveyor operable through a succession of operational cycles and including an endless conveyor assembly arranged for periodic travel along a predetermined path and through a coil spring loading station, and a conveyor driving device drivingly connected to the conveyor assembly and operative, upon each energization thereof, to drive the conveyor assembly through one operational cycle thereof, a coil spring forming machine located adjacent the predetermined path, operable through a succession of operational cycles to form a first coil spring, and, during a period of non-movement of the conveyor assembly, to load the first coil spring on the transfer conveyor, and including a coil spring forming driving device operative, upon each energization thereof, to drive the coil spring forming machine through one operational cycle thereof, and a control system operative to cause energization of the conveyor driving device in response to completion of one operational cycle of the coil spring forming driving device, and, thereafter, operative to cause energization of the coil spring forming driving device in response to completion of one operational cycle of the conveyor driving device.

The invention also provides a coil spring forming machine and transfer conveyor assembly comprising a transfer conveyor operable through a succession of operational cycles and including an endless conveyor assembly arranged for periodic travel along a predetermined path and through a coil spring loading station, and a conveyor driving device drivingly connected to the conveyor assembly and operative, upon each energization thereof, to drive the conveyor assembly through one operational cycle thereof, a first coil spring forming machine located adjacent the predetermined path, operable through a succession of operational cycles to form coil springs, and, during a period of non-movement of the conveyor assembly, to load a coil spring on the transfer conveyor, and including a first coil spring forming driving device operative, upon each energization thereof, to drive the first coil spring forming machine through one operational cycle thereof, a second coil spring forming machine located adjacent the predetermined path, operable through a succession of operational cycles to form coil springs, and, during a period of non-movement of the conveyor assembly, to load a coil spring on the transfer conveyor, and including a second coil spring forming driving device operative, upon each energization thereof, to drive the second coil spring forming machine through one operational cycle thereof, and a control system including first and second counting and switching devices which are respectively connected to one of (a) the conveyor driving device, and (b) the first and second coil spring forming driving devices, and which are respectively connectable to and disconnectable from the other of (a) the conveyor driving device, and (b) the first and second coil spring forming driving devices, the first counting and switching device being adjustable to select a desired number of successive operational cycles of the first coil spring forming machine, being operable to effect the selected desired number of successive operational cycles of the first coil spring forming machine by successive energization of the first coil spring forming driving device in response to each successive completion of the selected desired number of operational cycles of the conveyor driving device, and being operable, upon completion of the selected desired number of operational cycles of the conveyor driving device, to cause disconnection of the conveyor driving device and the first counting and switching device and connection of the conveyor driving device and the second counting and switching device, and the second counting and switching device being adjustable to select a desired number of successive operational cycles of the second coil spring forming machine, being operable to effect the selected desired number of successive operational cycles of the second coil spring forming machine by successive energization of the second coil spring forming driving device in response to each successive completion of the selected desired number of operational cycles of the conveyor driving device, and being operable, upon completion of the selected desired number of operational cycles of the conveyor driving device, to cause disconnection of the conveyor driving device and the second counting and switching device and connection of the conveyor driving device and the first counting and switching device.

The invention also provides a coil spring forming head which is periodically operative to at least partially form coil springs and which includes a wire feed advancing mechanism, a wire feed driving device drivingly connected to said wire feed advancing mechanism, a pitch control tool, a pitch control driving device drivingly connected to said pitch control tool and being operative in response to operation of said wire feed driving device, a diameter control tool, and a diameter control driving device drivingly connected to said diameter control tool and being operative in response to operation of said wire feed driving device.

The invention also provides a coil spring forming head which is periodically operative to at least partially form coil springs and which includes a wire feed advancing mechanism, a wire feed driving servo-motor drivingly connected to said wire feed advancing mechanism, a pitch control tool, a pitch control driving servo-motor drivingly connected to said pitch control tool and being operative in response to operation of said wire feed driving device, a diameter control tool, and a diameter control driving servo-motor drivingly connected to said diameter control tool and being operative in response to operation of said wire feed driving device.

The invention also provides a coil spring forming head which is periodically operative to at least partially form coil springs having a plurality of coils and which includes a wire feed advancing mechanism operative to feed the wire which is formed into coil springs, a pitch control mechanism operative to control the pitch of the coils of the coil springs being formed, a diameter control mechanism operative to control the diameter of the coils of the coil springs being formed, and a control including a storage area containing instructions for operation of said wire feed advancing mechanism, said pitch control mechanism, and said diameter control mechanism, a wire feed controller connected to said wire feed advancing mechanism to control operation thereof, a pitch controller connected to said pitch control mechanism to control operation thereof, a diameter controller connected said diameter control mechanism to control operation thereof, and a programmable switching device connected to said wire feed controller, to said pitch controller, and to said diameter controller and selectively connectable to said storage area to afford forwarding of selected instructions from said storage area to said wire feed controller, to said pitch controller, and to said diameter controller.

The invention also provides a coil spring forming head which is periodically operative to at least partially form coil springs having a plurality of coils and which includes a wire feed advancing device, a wire feed driving device drivingly connected to said wire feed advancing device and operative to feed the wire to be formed into coil springs, a pitch control tool, a pitch control driving device drivingly connected to said pitch control tool and being operative, in response to operation of said wire feed driving device, to control the pitch of the coils of the coil springs being formed, a diameter control tool, a diameter control driving device drivingly connected to said diameter control tool and being operative, in response to operation of said wire feed driving device, to control the diameter of the coils of the coil springs being formed, and a control including a storage area containing instructions for operation of said wire feed driving device, said pitch control driving device, and said diameter control driving device, a wire feed controller connected to said wire feed driving device to control operation thereof, a pitch controller connected to said pitch control driving device to control operation thereof, a diameter controller connected said diameter control driving device to control operation thereof, and a programmable switching device connected to said wire feed controller, to said pitch controller, and to said diameter controller and selectively connectable to said storage area to afford forwarding of selected instructions from said storage area to said wire feed controller, to said pitch controller, and to said diameter controller.

The invention also provides a coil spring forming head which is periodically operative to at least partially form coil springs having a plurality of coils and which includes a wire feed advancing device, a wire feed driving servo-motor drivingly connected to said wire feed advancing device and operative to feed the wire to be formed into coil springs, a pitch control tool, a pitch control driving servo-motor drivingly connected to said pitch control tool and being operative, in response to operation of said wire feed driving servo-motor, to control the pitch of the coils of the coil springs being formed, a diameter control tool, a diameter control driving servo-motor drivingly connected to said diameter control tool and being operative, in response to operation of said wire feed driving servo-motor, to control the diameter of the coils of the coil springs being formed, and a control including a storage area containing instructions for operation of said wire feed driving servo-motor, said pitch control driving servo-motor, and said diameter control driving servo-motor, a wire feed controller connected to said wire feed driving servo-motor to control operation thereof, a pitch controller connected to said pitch control driving servo-motor to control operation thereof, a diameter control controller connected said diameter control driving servo-motor to control operation thereof, and a programmable switching device connected to said wire feed controller, to said pitch controller, and to said diameter control controller and selectively connectable to said storage area to afford forwarding of selected instructions from said storage area to said wire feed controller, to said pitch controller, and to said diameter control controller. Other features and advantages of the invention will become apparent to those skilled in the art upon review of the following detailed description, claims and drawings. dr

DESCRIPTION OF THE DRAWINGS

FIG. 3 is an elevational view taken along line 3—3 of FIG. 2.

FIG. 4 is a plan view of the undersurface of one of the pallets included in the construction shown in FIG. 3.

FIG. 5 is an enlarged perspective view of the pallet shown in FIG. 4 with a coil spring located thereon when the pallet is in the coil spring loading station.

FIG. 21 is an enlarged plan view of the delivery mechanism shown in FIG. 20.

Figures 1, 2:
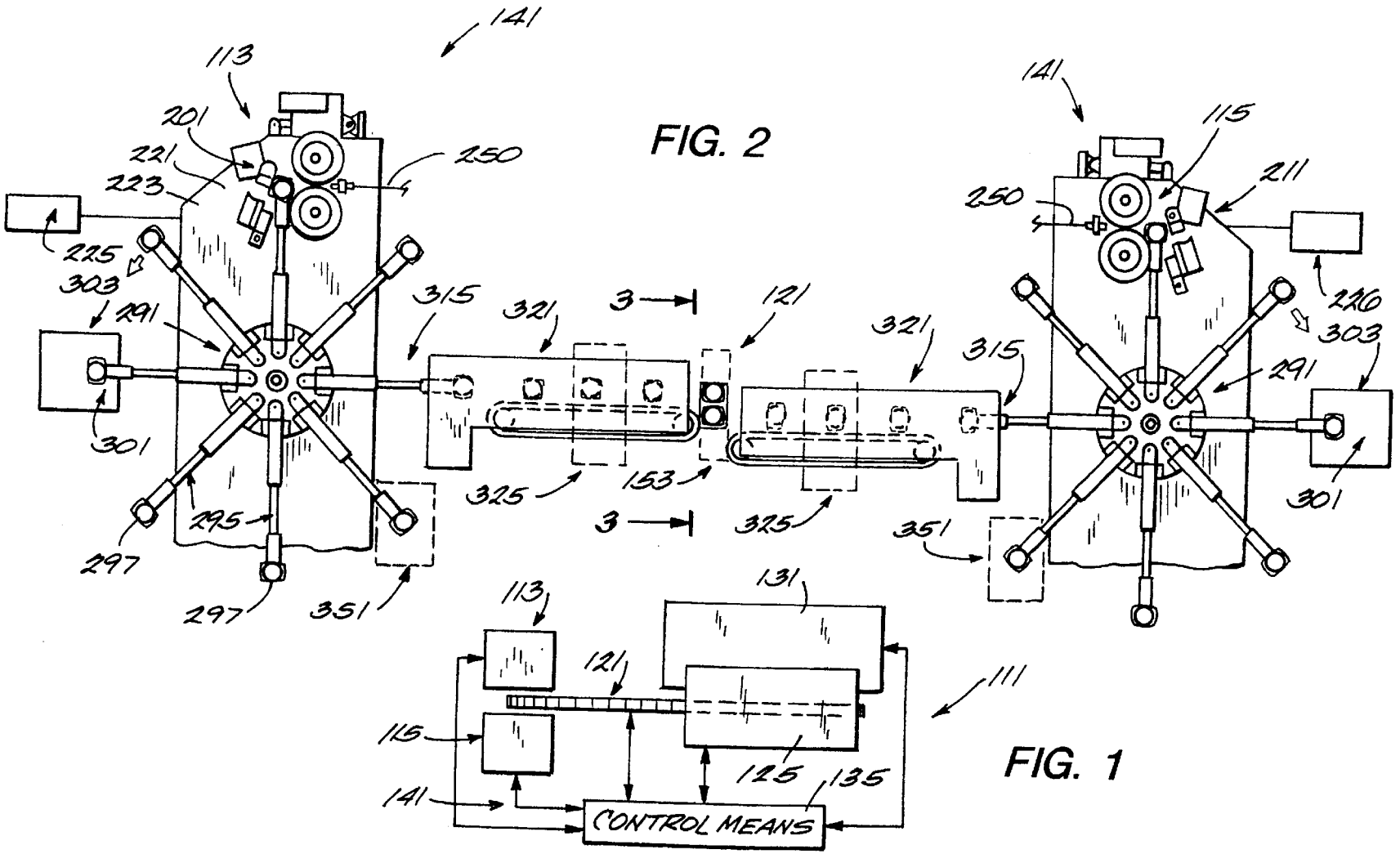
FIG. 1 is a schematic view of a coil spring forming and assembling machine which embodies various of the features of the invention.
FIG. 2 is a fragmentary end elevational view of one embodiment of a portion of the coil spring forming and assembling machine shown in FIG. 1.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is understood that the phraseology and terminology used herein is for the purpose of description and should not be regarded as limiting.

GENERAL DESCRIPTION OF THE INVENTION

Shown schematically in FIG. 1 of the drawings is a coil spring forming and assembling machine 111 including first and second coil spring forming machines 113 and 115 which form and deliver coil springs to a single, incrementally advancing transfer conveyor 121 which, in turn, delivers the coil springs to a coil spring transfer apparatus 125 which, in turn, delivers the coil springs to a coil spring assembly apparatus 131 which assembles the coil springs into a coil spring assembly.

The first and second coil spring forming machines 113 and 115 and the transfer conveyor 121 comprise an integrated coil spring forming machine and transfer conveyor assembly 141 in which the first and second coil spring forming machines 113 and 115 are respectively located on opposite sides of the transfer conveyor 121 for operation to simultaneously or alternately directly deliver fully formed (and tempered) coil springs to the single transfer conveyor 121. The coil spring forming and assembling machine 111 also includes a control system 135 in which operation of the coil spring forming machine(s) 113 and 115 are dependent on completion of the incremental advancement of the transfer conveyor 121, and in which operation of the transfer conveyor 121 is dependent on completion, and delivery, of a fully completed coil spring by one or both of the coil spring forming machine(s) 113 and 115.

More particularly, the transfer conveyor 121 includes (see FIG. 3) an endless conveyor chain or assembly 151 arranged for periodic or incremental travel along a predetermined path and through a coil spring loading station 153, and a (schematically illustrated) servo-operated driving motor or other device 155 which is suitably mounted on the transfer conveyor 121 and which is operatively connected to the transfer conveyor chain or assembly 151 for periodically or incrementally driving the transfer conveyor chain or assembly 151 on the predetermined path and through a series of incremental advances which are all of the same length. Any suitable servo-operated driving device, including a linear servo-motor, can be employed and, in the disclosed construction, a commercially available conveyor drive servo-motor 155 is employed.

The endless conveyor chain or assembly 151 includes a series of pivotally connected pallets 161 which are successively located in the loading station 153 incident to periodic or incremental travel of the transfer conveyor chain or assembly 151 on the predetermined path.

The pallets 161 can take various forms. In one embodiment shown in FIGS. 4 and 5, the pallets 161 are of generally identical construction, have a generally flat outer surface 162 adapted to receive one of the terminal end coils of a coil spring, and are generally rectangular in shape, having a length which, in the direction of travel of the transfer conveyor 121, is substantially equal to or slightly more than the major or largest diameter of two coil springs standing side-by-side. Each pallet 161 also includes one or more magnets 163 which are operative to hold the coil springs in place on the pallets 161 during advancement of the transfer conveyor 121. More particularly, in the specifically disclosed construction, each pallet 161 includes, on the outer surface thereof, a plurality of permanent magnets 163. Any suitable magnet construction can be employed.

Thus, as shown in FIG. 5, the bottom terminal convolution of the coil springs are magnetically held by the pallets 161 and the upper terminal convolutions thereof come into engagement (see FIG. 3) with a stationary compression bar 164 as the transfer conveyor 121 advances the coil springs away from the loading station 153.

The pallets 161 can be directly pivotally connected to each other or, alternatively, the pallets is 161 can be suitably mounted on, or carried by, a commercial chain. In the specific construction shown in FIG. 3, the pallets are mounted on a commercially obtainable chain.

Figure 10:
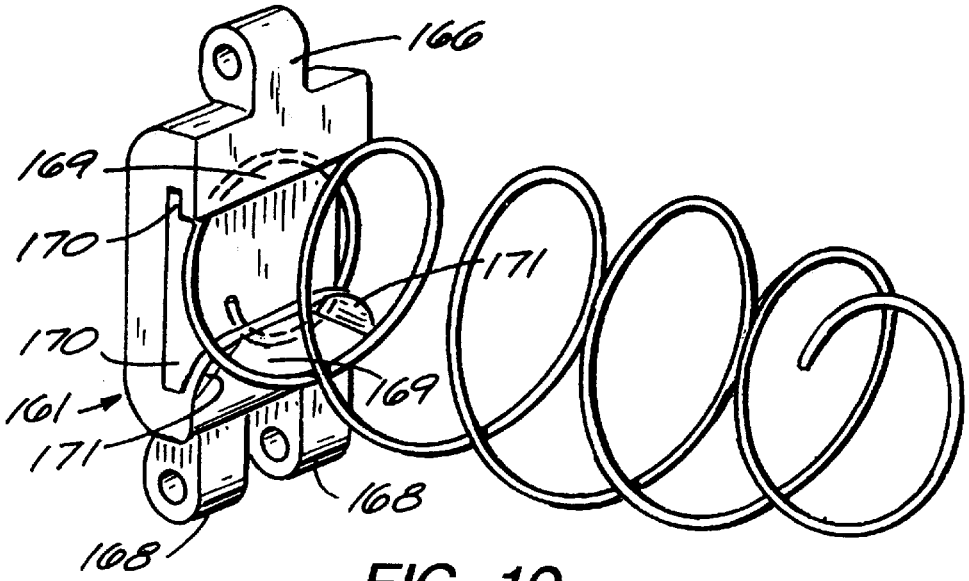
FIG. 10 is an enlarged perspective view of the pallet shown in FIGS. 8 and 9 with a coil spring located thereon when the pallet is in the coil spring loading station.
Figure 9:
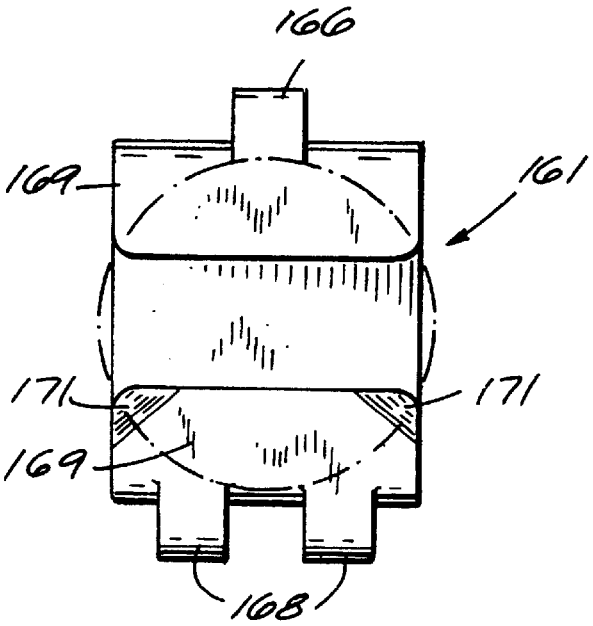
FIG. 9 is a top plan view of the pallet shown in FIG. 8.
Figure 8:
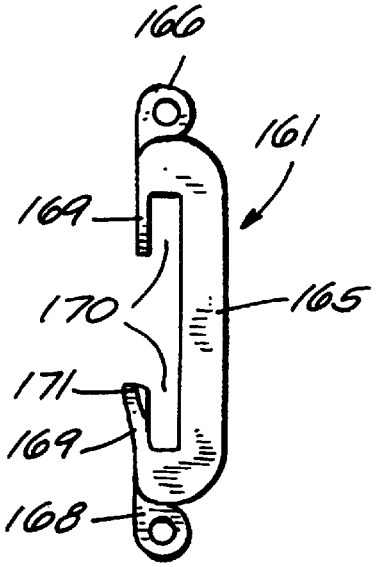
FIG. 8 is a side elevational view of one of the pallets included in the construction shown in FIG. 7.

Shown in FIGS. 8, 9, and 10, is another pallet construction in which each of the pallets 161 includes a lower generally rectangular base web 165 which has a lower generally flat surface. At one longitudinal end thereof, each of the pallets 161 includes a central ear 166 having a transverse bore adapted to accept a hinge pin (not shown) of suitable construction. At the other longitudinal end thereof, each of the pallets 161 includes a pair of transversely spaced ears 168 which receive therebetween the central ear 166 of an adjacent one of the pallets 161 and which include respective bores adapted to receive the just-mentioned hinge pin located in the central ear 166 of the adjacent one of the pallets 161.

The pallets 161 shown in FIGS. 8, 9, and 10 also include, adjacent each end, respective tabs 169 which extend toward each other in spaced relation to the base web 165 and which, in cooperation with the base web 165, define sockets or pockets 170 which are open on each side so to accommodate loading of the pallets 161 with coil springs from either side. The tab 169 at the other end, i.e., the end having the spaced ears 168, also includes, adjacent each of the sides, respective upwardly extending generally triangular wing portions 171. Accordingly, during coil spring loading, the pallet 161 is arranged to laterally receive one end coil or convolution of each coil spring to be transported. In this regard, the wing portions 171 accommodate the initial axial curve of the wire from the end coil.

In addition, the transfer conveyor 121 also includes a drive wheel or pulley 173 which is periodically and incrementally driven about a horizontal axis and relative to the coil spring loading station 153 by the conveyor drive servo-motor 155, and a wheel member or pulley (not shown) which is spaced from the drive wheel 173 and which is periodically and incrementally rotatably moveable about a fixed horizontal axis. The endless transfer conveyor chain or assembly 151 is partially trained around the drive wheel 173 and the wheel member for periodic and incremental travel along the predetermined path and through the coil spring loading station 153.

In operation, the pallets 161 are successively located in the loading station 153 incident to incremental travel or advancement of the transfer conveyor chain or assembly 151 on the predetermined path, with each such incremental advance occurring in response to each energization of the conveyor drive servo-motor 155 and being of the same length. Consequently, each incremental advance of the transfer conveyor chain or assembly 151 is approximately the length of the pallets 161. While the endless conveyor chain or assembly 151 is disclosed above as being periodically and incrementally advanced by the drive wheel 173 which, in turn, is driven by the conveyor drive servo-motor 155, if desired, the wheel member (not shown) could be driven by the conveyor drive servo-motor 155 instead of the drive wheel or pulley 173 or any other arrangement could be employed for incrementally advancing the transfer conveyor chain or assembly 151 incident to each energization of the conveyor drive servo-motor 155.

The first coil spring forming machine 113 includes (as shown in FIG. 2) a (schematically illustrated) servo-operated main forming machine driving motor or other device 225 which is suitably mounted on the first coil spring forming machine 113 and which is operative, upon each energization thereof, to cause actuation of the first coil spring forming machine 113 through one operational cycle thereof. Any suitable servo-operated driving device, including a linear servo-motor, can be employed and, in the disclosed construction, a first commercially available main forming machine drive servo-motor 225 is employed.

Figure 12:
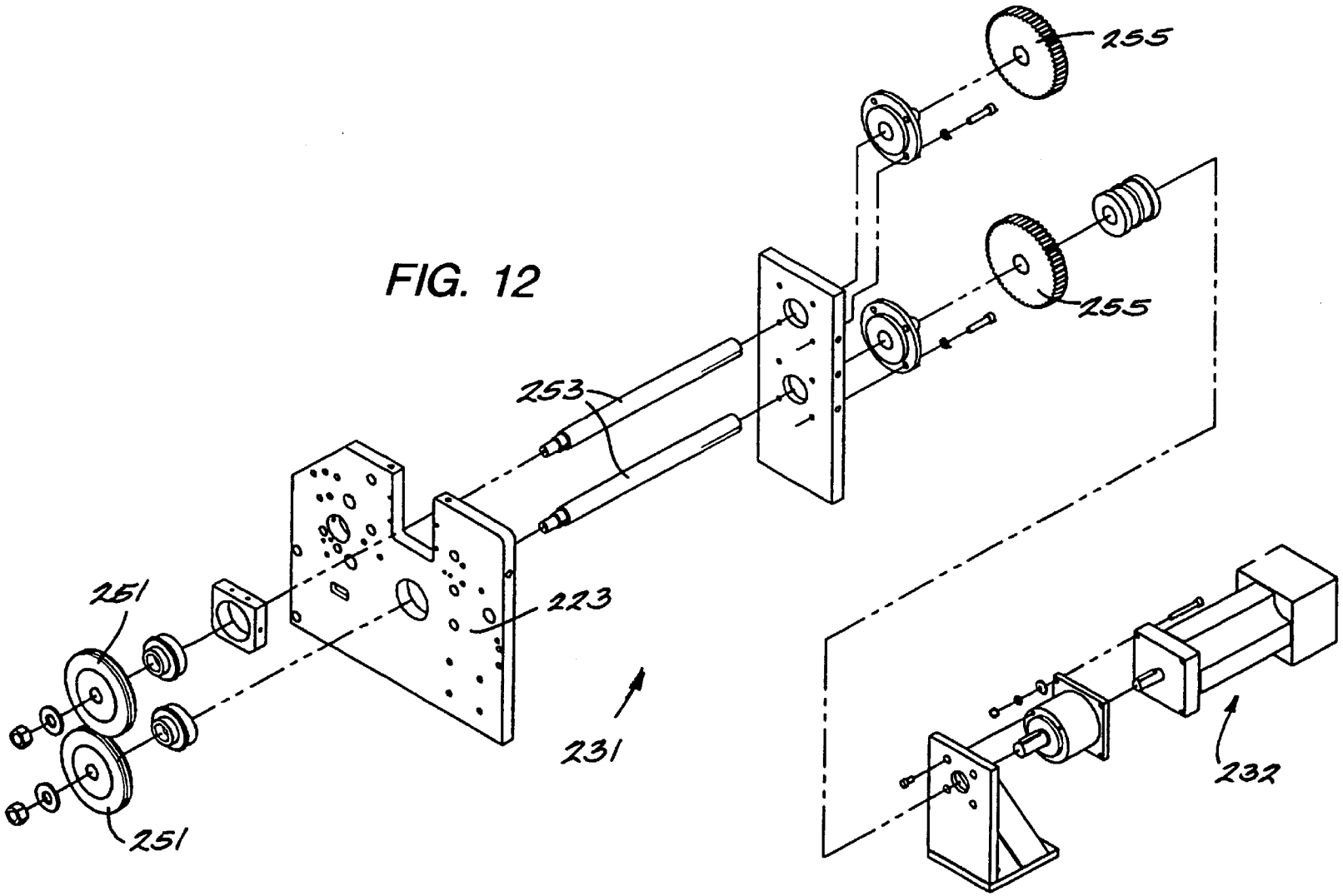
FIG. 12 is an exploded view of a wire feed advancing mechanism included in the coil spring forming and assembling machine shown in FIG. 11.

The servo-operated main forming machine drive device 225 controls energization of a wire feed advancing mechanism 231 (see FIG. 12), a pitch control mechanism 235 (see FIG. 13), and a diameter control mechanism 243 (see FIG. 14), (all still to be described) and specifically drives or powers a spoke assembly 291 and a delivery mechanism or conveyor 321 (all still to be described), all of which are part of the coil spring forming machine 113.

The first coil spring forming machine 113 also includes a first coil spring forming head 201 which is periodically operative to successively at least partially form coil springs.

In addition, the first coil spring forming machine 113 operates, when one of the pallets 161 is in the loading station 153 and during a period of non-movement of the conveyor chain or assembly 151, to deliver or load a fully or completed formed (and tempered) coil spring on the one of the pallets 161 located in the loading station 153.

Except for being located on the opposite side of the transfer conveyor 121 from the first coil forming machine 113 and except for preferably being of the opposite hand, i.e., being left-handed instead of being right-handed, the second coil spring forming machine 115 is generally of identical construction to the first coil spring forming machine 113, could be of the same hand, and includes a (schematically illustrated) second servo-operated main forming machine driving motor or other device 226 which is suitably mounted on the second coil spring forming machine 115 and which is operative, upon each energization thereof, to cause actuation of the second coil spring forming machine 115 through one operational cycle thereof. Any suitable servo-operated driving device, including a linear servo-motor, can be employed and, in the disclosed construction, a second commercially available main forming machine drive servo-motor (226) is employed.

The second main forming machine drive servo-motor 226 controls energization (with respect to the second coil spring forming machine 115) of a wire feed advancing mechanism 231, a pitch control mechanism 235, and a diameter control mechanism 243, (all still to be described) and specifically drives or powers a spoke assembly 291 and a delivery mechanism or conveyor 321 (all still to be described), all of which are part of the coil spring forming machine 115.

In addition, the second coil spring forming machine 115 also includes a second coil spring forming head 211 which is periodically operative to successively at least partially form coil springs. Still further in addition, the second coil spring forming head 211 operates, when the one of the pallets 161 is in the loading station 153 and during a period of non-movement of the conveyor chain or assembly 151, to load a fully or completely formed (and tempered) coil spring on the one of the pallets 161 located in the loading station 153.

In an alternative embodiment, as will be disclosed, the second coil forming machine 115 can be operative to periodically form coil spring and, when the next one of the pallets 161 is in the loading station 153 and during the next period of non-movement of the conveyor chain or assembly 151, to load a completed or fully formed (and tempered) coil spring on the next one of the pallets 161.

Because the first and second coil spring forming machines 113 and 115 are generally identically constructed, only the first coil spring forming machine 113 will be further described. In this regard, the first servo-operated main forming machine drive motor or other device 225 (and the second servo-operated main forming machine drive motor 226) can take any suitable form, including a linear servo-motor, and in the disclosed construction, is preferably in the form of a commercially available servo-motor which is suitably mounted on the associated one of the coil spring forming machines 113 and 115.

Because the first and second coil spring forming heads 201 and 211 are also of the same construction, except for being left- and right-handed, only the coil spring forming head 201 will be described. In this regard, the coil spring forming head 201, as shown best in FIGS. 2 and 11 through 14, is operative successively to at least partially form a series of generally identical coil springs which can be either knotted or unknotted coil, and includes a frame 221 including a generally vertically extending frame member 223.

Further in this regard, the wire feed advancing mechanism 231 incorporated in the first coil spring forming head 201 (see FIG. 12) includes and is driven by a servo-operated driving motor or other device 232 which is suitably mounted in the frame 221 and which is operative or energized in response to operation of the main forming machine drive servo-motor 225 (or 226). The servo-operated driving motor or other device 232 can take any suitable form, including a linear servo-motor, and in the disclosed construction, is preferably in the form of a commercially available wire feed servo-motor (232).

In addition, the pitch control mechanism 233 incorporated in the first coil spring forming head 201 includes (see FIG. 13) a pitch control tool 235 and a servo-operated driving motor or other device 239 which is suitably mounted on the frame 221, which is drivingly connected to the pitch control tool 235, and which is operative, in response to each operation of the wire feed servo driving motor or other device 232, to drive or locate the pitch control tool 235. The just-mentioned pitch control servo-operated driving motor or other device 239 can take any suitable form, including a linear servo-motor, and in the disclosed construction, is preferably in the form of a commercially available pitch control servo-motor 239.

Still further in addition, the diameter control mechanism 243 incorporated in the first coil spring forming head 201 includes (see FIG. 14) a diameter control tool 245 and a servo-operated driving motor or other device 249 which is suitably mounted on the frame 221, which is drivingly connected to the diameter control tool 245, and which is operative, in response to each operation of the wire feed servo-motor 232, to drive or locate the diameter control tool 245. The servo-operated driving motor or other device 249 can take any suitable form, including a linear servo-motor, and in the disclosed construction, is preferably in the form of a commercially available diameter control servo-motor (249).

The wire feed advancing mechanism 231 can be of any suitable construction and, in the specifically disclosed construction, the wire feed advancing mechanism 231 includes (see FIGS. 11 and 12) a pair of feed rollers 251 which are operative to incrementally advance a wire 250 from which the coil springs are formed. The feed rollers 251 are respectively mounted on a pair of drive shafts 253 which are respectively rotatably supported by bearings fixedly supported by the frame member 223 and which are respectively fixed to, and rotatably driven by, a pair of meshing gears 255. One of the meshing gears 255 is rotatively driven by the wire feed drive servo-motor 232 which is fixedly mounted on the frame 221.

The pitch control tool mechanism 233, including the pitch control tool 235, can also be of any suitable construction.

Figure 13:
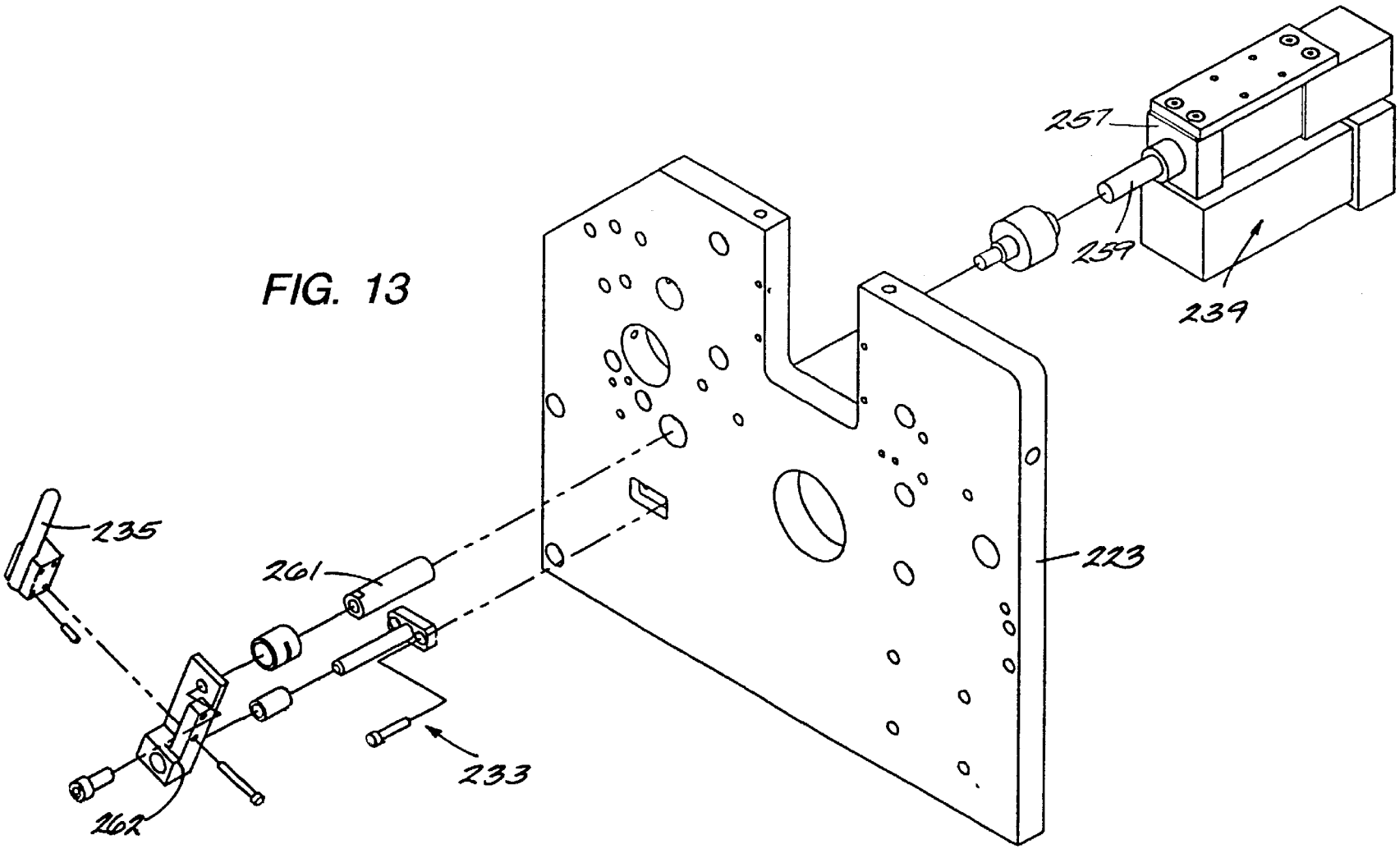
FIG. 13 is an exploded view of a pitch control mechanism included in the coil spring forming and assembling machine shown in FIG. 11.

Various constructions can be employed to drivingly connect the pitch control tool 235 to the pitch control servo-motor 239. In the preferred and specifically disclosed construction, (as shown in FIG. 13) the pitch control servo-motor 239 is fixedly mounted on the frame 221 and is connected by a suitable ballscrew mechanism 257 to an output member 259 so as to convert the rotary output of the pitch control servo-motor 239 into axial translatory movement of the output member 259. As shown in the drawings, the output member 259 passes through a bearing supported in the frame member 223 and includes an outer end 261 having mounted thereon a pitch control tool holder 262 to which the pitch control tool 235 is fixed. The pitch control tool holder 262 and the pitch control tool 235 have common movement with the output member 259 incident to operation of the pitch control servo-motor 239. The pitch control tool 235 engages the wire 250 during coil spring formation to effect the desired coil spring pitch.

The diameter control mechanism 243, including the diameter control tool 245, can also be of any suitable construction.

Figure 11:
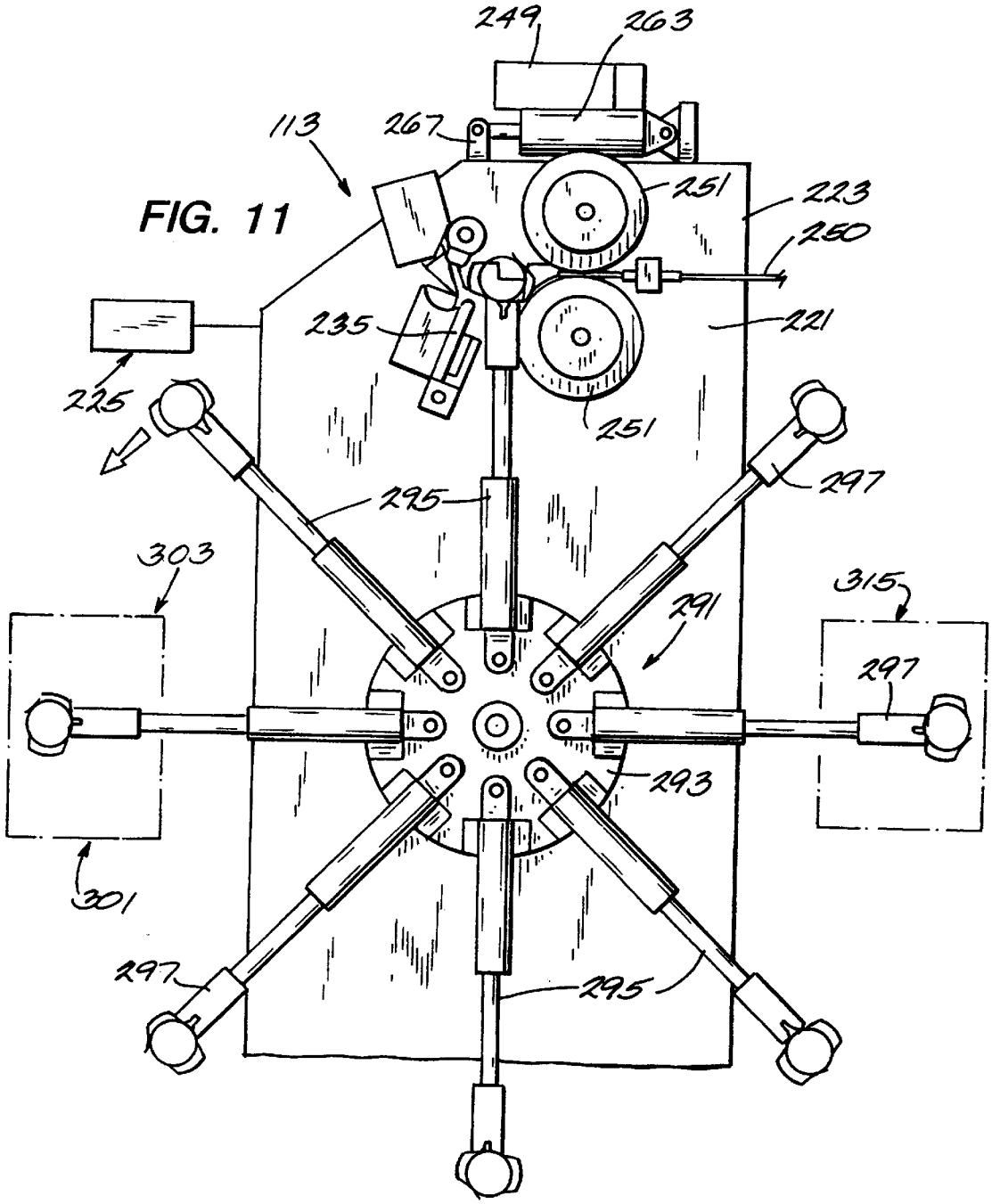
FIG. 11 is an enlarged view of one of the coil spring forming machines included in the coil spring forming and assembling machine shown in FIG. 1.
Figures 14, 15:
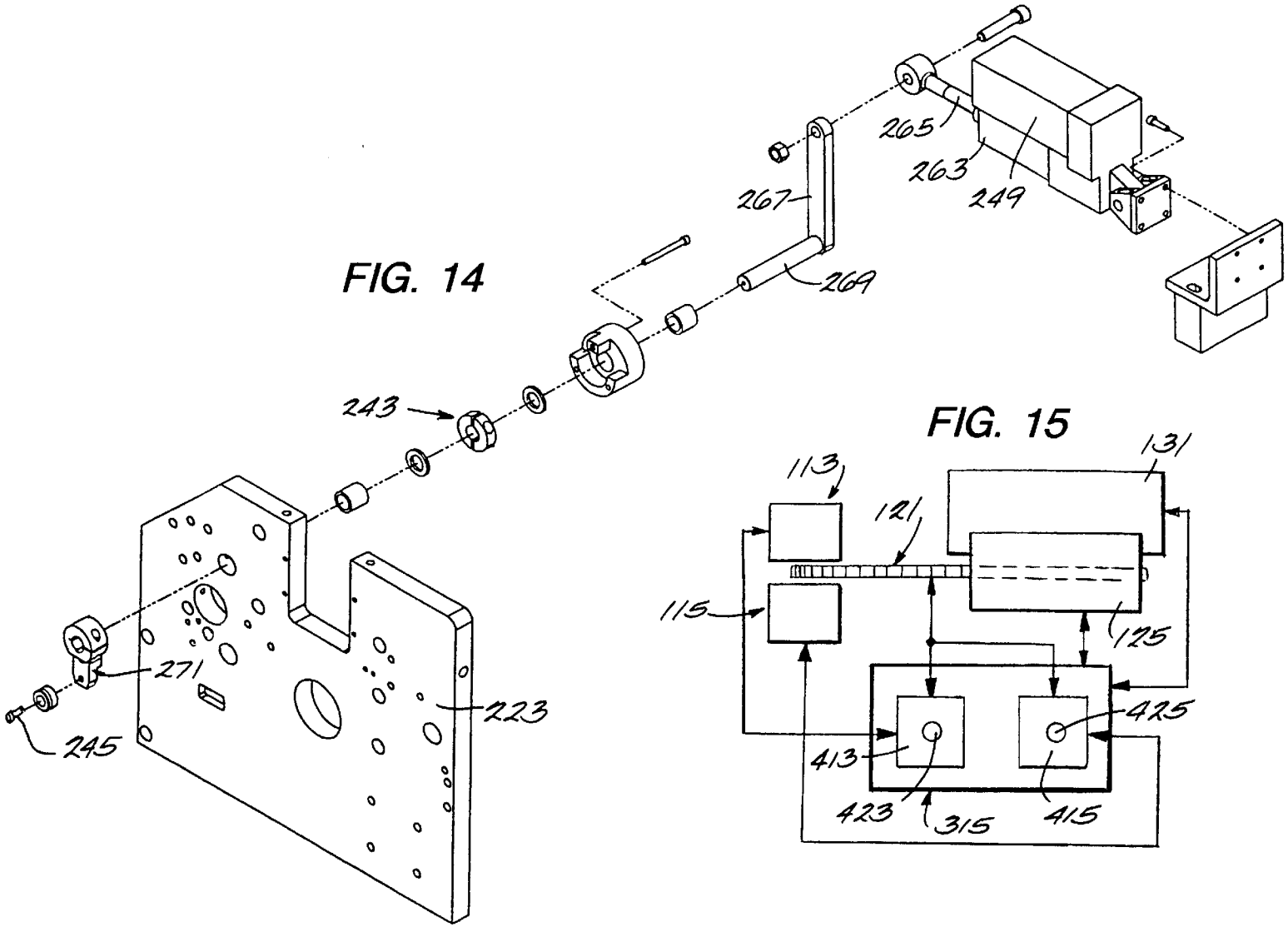
FIG. 14 is an exploded view of a diameter control mechanism included in the coil spring forming and assembling machine shown in FIG. 11.
FIG. 15 is a schematic view of another embodiment of a coil spring forming and assembling machine which embodies various of the features of the invention.

Various constructions can be employed to drivingly connect the diameter control tool 245 to the diameter control servo-motor 249. In the preferred and specifically disclosed construction, (as shown in FIGS. 11 and 14) the diameter control servo-motor 249 is pivotally mounted on the frame 221 and is connected by a suitable ballscrew mechanism 263 to an output member 265 so as to convert the rotary output of the diameter control servo-motor 249 into axial translatory movement of the output member 265. As shown in the drawings, at the outer end thereof, the output member 265 is pivotally connected to one end of a lever 267 which, at the other end thereof, is fixedly connected to a shaft member 269 which passes through a bearing fixedly supported by the frame member 223 and which, at the outer end thereof, includes a radially outwardly extending diameter control finger 271 which pivots about the axis of the shaft member 269 incident to axial translatory movement of the output member 265 driven by the diameter control servo-motor 249. At the outer end thereof, the diameter control finger 271 includes the diameter control tool 245 which engages the wire 250.

Both the pitch control servo-motor 239 and the diameter control servo-motor 249 are dependent upon, and are operated or energized in response to, energization of the wire feed servo-motor 232. However, the operation of the pitch control servo-motor 239 and the diameter control servo-motor 249 can be varied by suitable controls in order to vary the pitch and diameter of the coil springs being formed. Notwithstanding, and to repeat, the pitch control servo-motor 239 and the diameter control servo-motor 249 operate only in response to, and during the operation of, the wire feed servo-motor 232.

Figure 19:
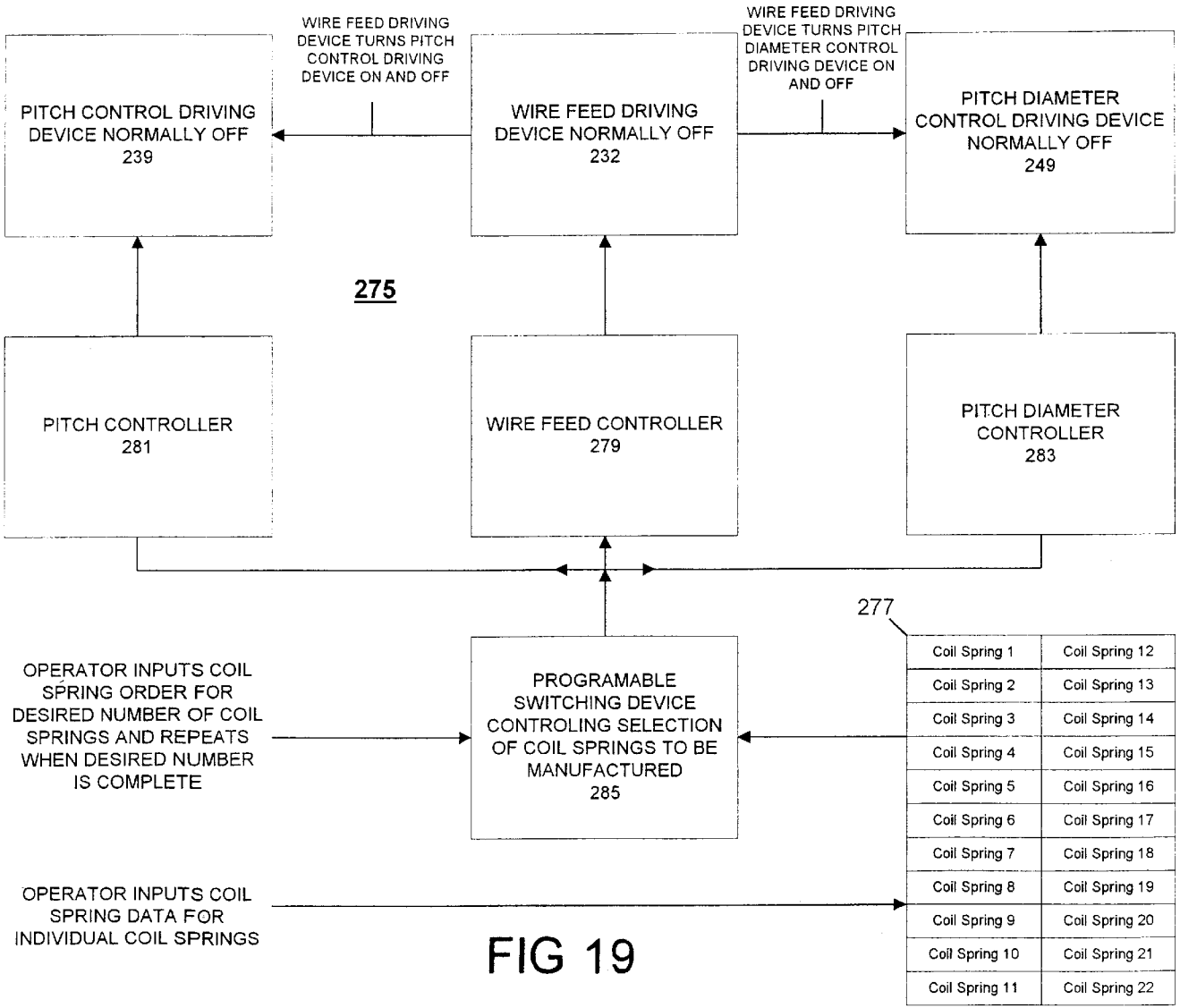
FIG. 19 is a diagrammatic view of one embodiment of a control incorporated in the coil spring forming machines shown in FIG. 2.
Figures 20, 24:
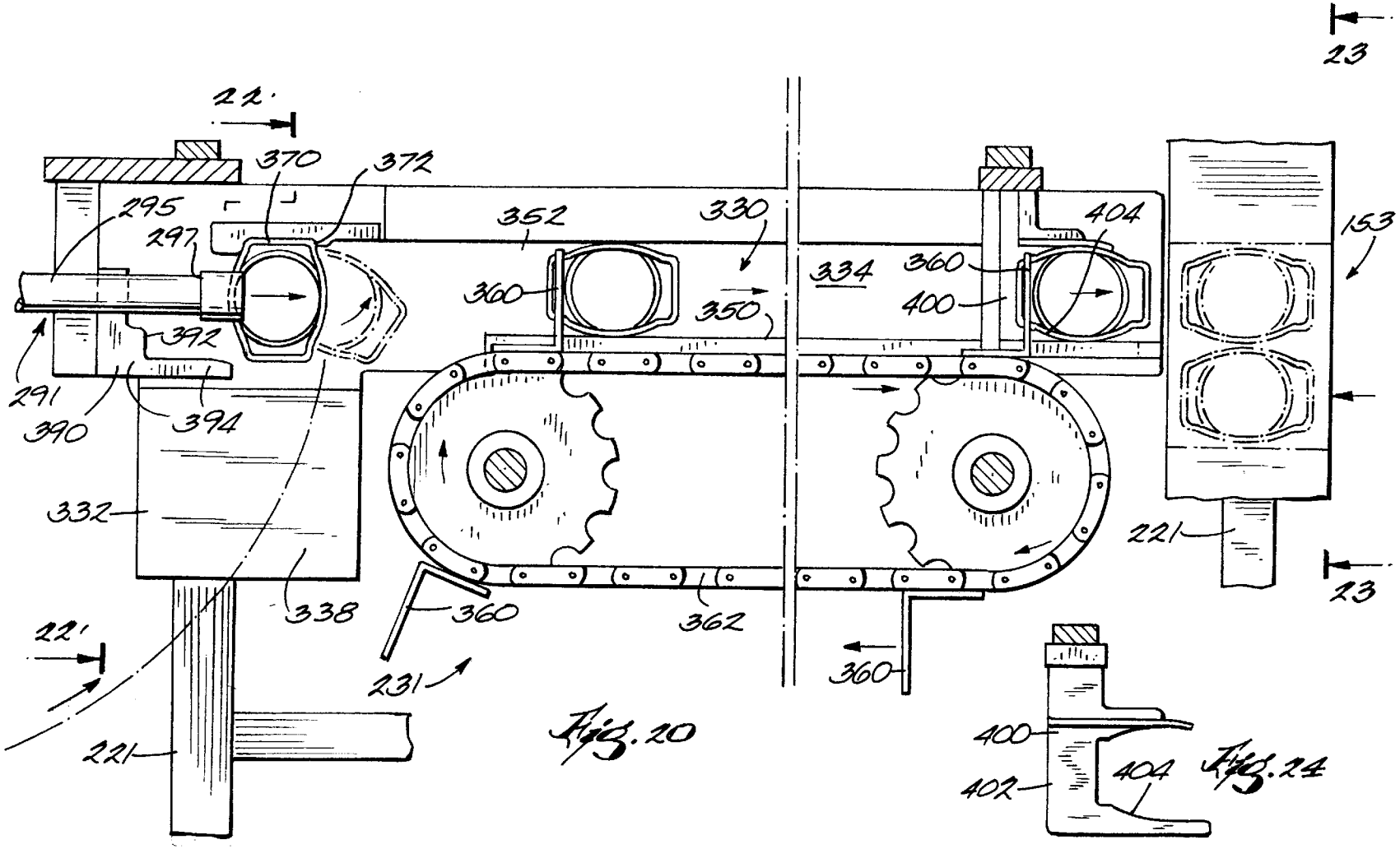
FIG. 20 is an enlarged side elevational view of the delivery mechanism incorporated in the coil spring forming machines included in the coil spring forming and assembling machine shown in FIG. 2.
FIG. 24 is a fragmentary view of a portion of the delivery mechanism shown in FIG. 20.
Figure 22:
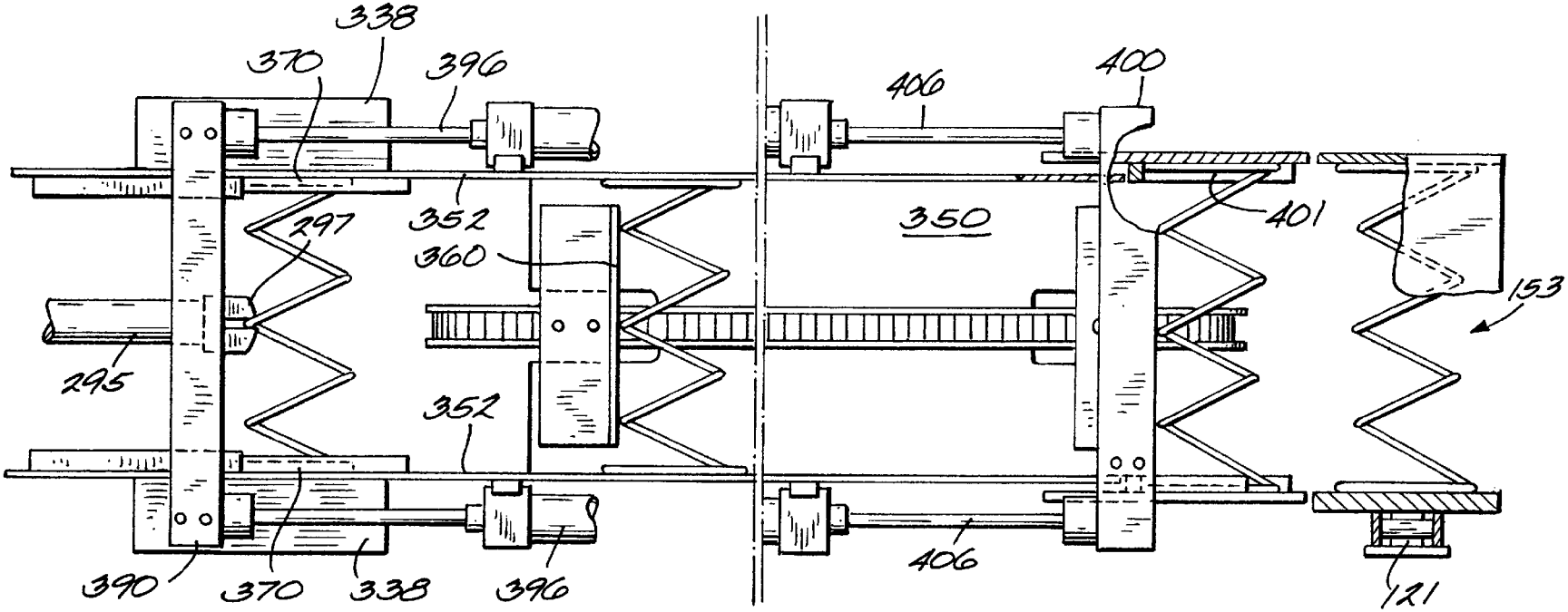
FIG. 22 is a view, partially in section, taken along line 22—22 of FIG. 20.
Figure 23:
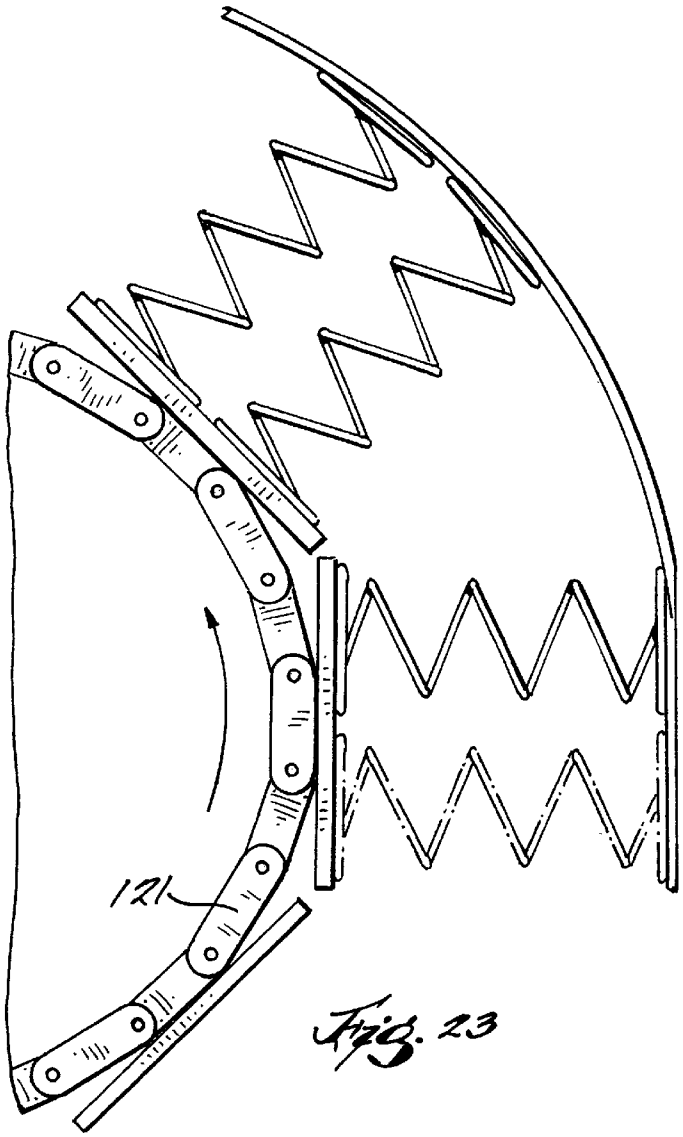
FIG. 23 is a view taken along line 23—23 of FIG. 20.
Figure 22:
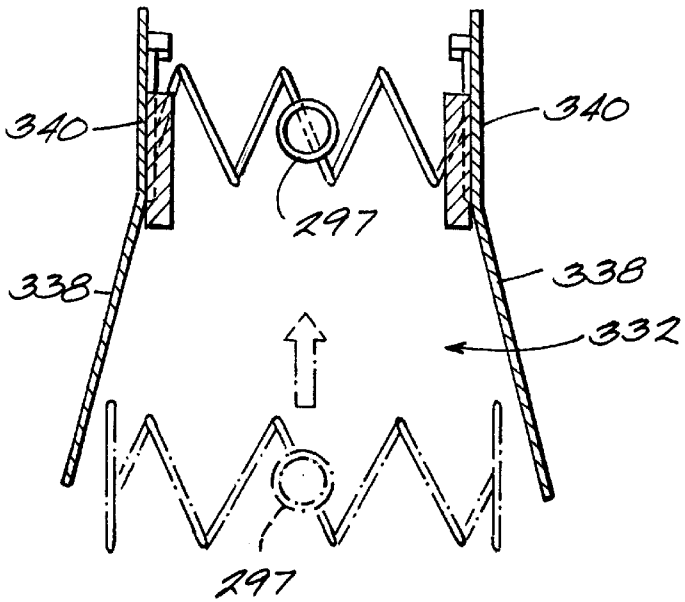

The coil spring forming machines 113 and 115 also respectively includes, as shown in FIG. 19, a control 275 permitting automatic variation of the physical parameters of the coil springs to be formed, manufactured, or produced. In other words, the control 275 can be employed to produce coil springs of the same or differing pitch and diameter in a single row of spring coils to be transferred from the transfer conveyor 121 to the coil spring transfer apparatus 125.

More specifically in this regard, the control includes a memory or storage area 277 which can of any suitable construction and which is operative to store wire advancing, pitch, and diameter parameters or instructions for each of a number of physically different coil springs (22 in the illustrated construction) which can be formed, produced or manufactured by the coil spring forming machines 113 and 115.

In addition, the control 275 includes a wire feed controller 279 which controls the length of wire to be advanced for each coil spring, a pitch controller 281 which controls the pitch of the coils of the coil springs, and a diameter controller 283 which controls the diameter of the coils of the coil springs. The wire feed controller 279, the pitch controller 281, and the diameter controller 283 can be of any suitable construction, are respectively connected to the wire feed mechanism 231, the pitch control mechanism 233, and the diameter mechanism 243. More specifically, the wire feed controller 279, the pitch controller 281, and the diameter controller 283 are respectively connected to the wire feed driving device 232, the pitch control driving device 239, and the diameter driving device 249, and are, as indicated, operable to control the driving devices to obtain the desire length of feed wire, the desired pitch, and the desired diameter.

Still further in addition, the control 275 includes a programmable switching device 285 which can be of any suitable construction and which is operative to inform the wire feed controller 279, the pitch controller 281, and the pitch diameter controller 283 of the parameters of the coil springs to be formed or manufactured in accordance with a previously arranged or programmed coil spring sequence.

In operation, the operator initially inputs into the storage area 277 the parameters for 22 differing coil springs. The operator then inputs, into the programmable switching device 285, a desired sequence or order of coil springs to be formed or manufactured. Thereafter, the programmable switching device 285 inputs into the wire feed controller 279, the pitch controller 281, and the pitch diameter controller 283 the information required to manufacture the first of the coil springs in the desired prearranged sequence or order. Thereafter, the pitch control driving device will be actuated, as already explained, to cause the wire feed advancing mechanism 231, the pitch control mechanism 233, and the pitch diameter control mechanism 243 to operate so that the coil spring forming machines 113 and 115 produce the desired coil springs. When the first of the coil springs in the desired sequence or order is formed or manufactured, the programmable switching device 285 will then input to the controllers 279, 281, and 283 the information for the formation or manufacture of the next coil spring in the prearranged sequence or order. The second coil spring in the prearranged sequence or order can be of the same construction as the first coil spring or can be of physically different construction. After formation or manufacture of all of the coil springs in the prearranged sequence or order to form a row of coil springs, the programmable switching device 285 then operates to commence the formation or manufacture of another prearranged series or sequence of coil springs.

Thus, the control 275 is operative, in response to each successive actuation of the coil spring forming machines 113 and 115, to produce or form the same coil spring as previously manufactured, or to produce or form another coil spring, all in accordance with a previously programmed schedule or prearranged sequence or predetermined programmed series of coil springs of the same or differing parameters, which coil springs are directly delivered to or supplied to the transfer conveyor 121.

The first coil forming machine 113 also includes (as shown in FIG. 11) a rotating spoke assembly 291 which is of known construction, which is rotatably mounted on the frame 221, and which includes a hub 293, and a plurality of spokes or arms 295 which extend from the hub 293 and which respectively include, at the outer end thereof, a releasable gripping mechanism 297.

The spoke assembly 291 is incrementally rotatably driven by the main forming machine drive servo-motor 225 in such manner as to serially locate one of the spokes 295 and associated gripping mechanism 297 in position to grasp a partially formed coil spring as the partially formed coil spring exits the coil forming head 201. Thereafter, the spoke assembly 291 incrementally rotates in response to each succeeding energization of the main forming machine drive servo-motor 225 so as to first move the gripped coil spring to a bending or other work station 301. At the bending or other work station 301, the axially spaced terminal coils or ends of the coil spring are further formed by suitable, schematically illustrated, wire forming mechanism(s) 303 which are of known construction and which are supported by the frame 221 at the bending or other work station 301. The wire forming mechanism(s) 303 are utilized to further form the partially formed coil springs by performing such operations as bending, knotting, crimping, or any other further formation of the coil spring ends. The wire forming mechanism(s) 303 can be driven by any suitable arrangement, including a servo-operated drive motor(s) or other device(s) (not shown) which, preferably, can be in the form of a commercially available servo-motor(s) which is/are mounted on the frame 221.

Thereafter, the spoke assembly 291 again incrementally rotates to move the gripped coil spring so as to serially deliver the partially formed coil spring to a transfer station 315 wherein the gripped coil spring is released and is contacted (see FIG. 2) by a delivery mechanism or conveyor 321 which is part of the first coil spring forming machine 113, which is powered by the main forming machine drive servo-motor 225, and which can be of any suitable construction.

In the construction shown in FIG. 2, the delivery mechanism or conveyor 321 includes a schematically illustrated apparatus 325 which is operative (if formation of the coil spring was not completed by the wire forming mechanism(s) 303) to complete the forming of the coil springs by finally bending the ends of the axially spaced terminal coils and which is operative to temper the coil springs during travel therealong to the transfer conveyor 121 at the coil spring loading station 153. Any suitable final bending and coil spring tempering apparatus can be employed, such as the apparatus disclosed in New Zealand Patent Application Serial No. 08/964,259, filed May 27, 1996, and entitled "Spring Formation".

The delivery mechanism or conveyor 321 is arranged to deliver the fully formed and tempered coil springs to the pallets 161 of the transfer conveyor 121 when, as already noted, the pallets 161 are located in a vertical disposition or orientation. The delivery mechanism or conveyor 321 can also include a mechanism (not shown) for angularly orientating the coil spring ends so that, upon delivery of the coil springs to the transfer conveyor 121, the coil spring ends will be properly orientated on the transfer conveyor 121.

In the particularly disclosed construction, as shown in FIGS. 20 through 24, the delivery mechanism or conveyor 321 of the coil spring forming machine(s) 113,115 is mounted on the coil spring forming machine frame 221 and includes a pathway 330 including a funnel portion 332 (see FIG. 22) and a delivery portion 334. While other constructions can be employed, the funnel portion 332 is located in the transfer station 315 and includes two opposed plates 338 which converge in the upward direction and which at their upper ends, is respectively include top segments 340 extending vertically in horizontally spaced relation. As the spoke assembly 291 rotatably advances and swings the associated coil spring upwardly, the opposed plates 338 serve to slightly axially compress the coil spring.

The delivery portion 334 extends generally horizontally between a receiving end extending from the funnel portion 332 to a delivery end located adjacent the coil spring loading station 153 and includes a floor or bottom plate 350 and a pair of horizontally spaced side plates or walls 352 which extend upwardly from the floor or bottom plate 350, and which, in general, extend in generally coplanar relation from the inside surfaces of the top segments 340 of the opposed plates 338 of the funnel portion 332 and terminate in spaced relation to the coil spring loading station 153.

The delivery portion 334 also includes a plurality of paddles or pushers 360 which are fixed to a flexible drive chain 362 for common travel therewith and which travel in an orbit including an upper run located adjacent the floor or bottom plate 350 of the pathway 330. As already indicated, the drive chain 362 is driven or powered by the main forming machine driving device 225. As the drive chain 362 moves along the upper run, the paddles or pushers 360 extend upwardly from the floor or bottom plate 350 of the delivery portion 334 of the pathway 330 and between the side plates 352 to engage the coil springs and displace the coil springs from the receiving end to the delivery end of the delivery portion 334.

At the coil spring receiving end thereof, the delivery portion 334 also includes stationary and moveable structure for turning the coil spring through about 90 degrees and for advancing the coil springs into positions for engagement by the paddles or pushers 360 for advancement to the coil spring delivery end.

While other constructions can be employed, in the disclosed construction, the stationary structure includes, adjacent each of the side plates or walls 352, a downwardly opening recess 370 and a forwardly located wall segment 372. As a coil spring is swung upwardly by the spoke assembly 291 and after slight compression by the convergent opposed plates 338, the upwardly leading flat segments of the terminal or end coils of the coil spring enter into the recesses 370. While other constructions can be employed, in the disclosed construction, the moveable structure includes a reciprocable transfer bracket 390 which is advanced and retracted relative to the receiving end of the pathway 330 between retracted and extended positions and which includes two horizontally spaced and extending legs 392 moveable along the side plates or walls 352 adjacent the bottom plate or wall 350 and respectively including stepped surfaces 394 which engage lower portions of the terminal or end coils of the coil spring to rotate the coil spring about a fulcrum defined by engagement of the coil spring with the wall segments 372 in response to advancement of the legs 392 in the horizontal direction toward the delivery end of the delivery portion 334. After such rotation and advancement toward the delivery end, the coil spring is located in position to be engaged by one of the paddles or pushers 360 as the paddles or pushers 360 advance along the upper run of the orbital path and enter behind the coil spring.

Any suitable arrangement can be employed to advance and retract the moveable structure or transfer bracket 390 between the retracted and extended positions. In the disclosed construction, pneumatic cylinders or rams 396, connected between the frame 221 and the transfer bracket 390, are employed.

At the coil spring delivery end, the delivery portion 334 also includes moveable structure for advancing coil springs from the pushing paddles 360 and into the coil spring loading station 153 where the coil springs is engaged by, magnetically attracted to, and held by the transfer conveyor 121. While other constructions can be employed, in the disclosed construction, the moveable structure is in the form of a delivery bracket 400 which is advanced and retracted relative to the delivery end of the delivery portion 334 between retracted and advanced positions and which includes two horizontally spaced and extending legs 402 moveable along respective horizontal paths respectively located immediately laterally outside of the side plates or walls 352 and immediately beyond the end of the side plates or walls 352 adjacent the loading station 153 and hence the transfer conveyor 121. The legs 402 each include a recessed cutout or notch 404 which, when the legs 402 are in the retracted position, and in response to coil spring advancement by one of the paddles or pushers 360 beyond the delivery ends of the side plates or walls 352, receives the terminal or end coils of the coil spring in response to axially expansion of the coil spring to a less compressed condition. Stationary plates 408 located laterally outwardly of the legs 402 and fixed to the frame 221 prevent excessive expansion of the coil spring. Upon receipt of the terminal or end coils of the coil spring in the recessed cutouts or notches 404, the delivery bracket 390 is advanced from the retracted position to the advanced position wherein the coil spring is located in the loading station 153 between one of the movable pallets 161 and a stationary arcuate guide 410.

Any suitable arrangement can be employed to advance and retract the delivery bracket 400 between the retracted and advanced positions. In the disclosed construction, pneumatic cylinders or rams 406, connected between the frame 221 and the delivery bracket 400, are employed.

In the embodiment shown in FIG. 2, as will be is more fully disclosed hereinafter, the coil spring forming machines 113 and 115 simultaneously deliver coil springs to the transfer conveyor 121 so that the coil springs are located in side-by-side relation in the direction of travel of the transfer conveyor 121. In this regard, the delivery mechanism or conveyor 321 of one of the coil spring forming machines 113 and 115 is located vertically (as shown in FIG. 2) so as to deliver coil springs to the upper half of the pallet 161 which extends vertically in the loading station 153. The other of the coil spring forming machines 113 and 115 is located or arranged so that the delivery mechanism or 321 is at a lower vertical location so as to deliver coil springs to the lower half of the same pallet in the loading station 153.

Figure 7:
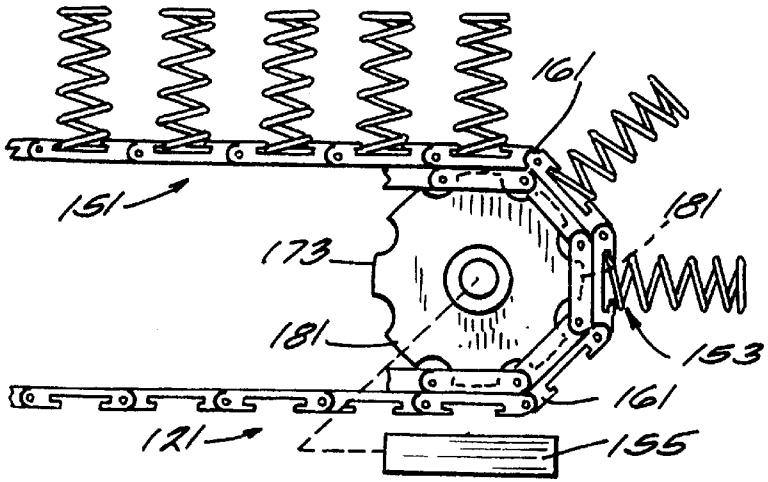
FIG. 7 is an elevational view taken along line 7—7 of FIG. 6.

In the embodiment shown in FIG. 7, as will be more fully disclosed hereinafter, the coil spring forming machines 113 and 115 alternately deliver coil springs to the transfer conveyor 121. More specifically, one of the coil spring forming machines 113 and 115 is operative to deliver a coil spring to the pallet 161 which extends vertically in the loading station 153 and then, after an incremental advancement of the transfer conveyor 121, the other one of the coil spring forming machines 113 and 115 is operative to deliver a coil spring to the next pallet 161 which is then vertically located in the loading station 153.

Alternatively, if desired, the coil spring forming machine (s) 113 and 115 can be arranged to temper the coil springs by a suitable tempering mechanism 351 located at a tempering station situated along the path of the spoke assembly 291 and during the dwell of the spoke assembly 291 between energizations of the main forming machine drive servomotor 255. Also, if desired, the coil spring forming machine (s) 113 and 115 can be located so as to enable the spoke assembly 291 to directly and serially deliver fully formed and tempered coil springs to the transfer conveyor 121, without employing the delivery mechanism or conveyor 321 described above.

In another alternative construction, a linearly operating transport device or mechanism (not shown) can be employed (in place of the spoke assembly 291) between a coil spring forming head and the loading station 153 associated with the transfer conveyor 121. More specifically, in this construction, the transport mechanism (not shown) serves to linearly carry a partially formed coil spring from a suitable coil spring forming head to a first or coil spring bending or knotting station (which includes a suitable mechanism for bending or knotting), and, simultaneously, to carry the previously formed coil spring from the first station to a second or tempering station (including a suitable tempering device). Thereafter, the tempered coil spring can be delivered to the loading station 153 by another coil spring conveying device. In general, any suitable construction can be employed for transporting coil springs from the coil spring forming heads to the loading station 153 of the transfer conveyor 121.

The coil spring forming and assembling machine 111 also includes the before-mentioned control means or system 135 which coordinates the operation of the coil spring forming machine(s) 113 and 115 and the transfer conveyor 121 (as well as the transfer apparatus 125 and the assembly apparatus 131). In response to operation of the control system 135, one operational cycle of the conveyor drive servomotor 155 causes one incremental advance of the transfer conveyor 121. Upon completion of such incremental conveyor assembly advance, the first and second main forming machine drive servo-motors 225 and 226 are energized to cause advancement by the wire feed servo-motor 232 of the wire 250 through the coil forming head 201, thereby partially forming a coil spring by the associated coil forming head 201, to cause one increment of rotation of the associated spoke assembly 291 by the associated main forming machine drive servo-motor 225 or 226, to cause one operation of the bending mechanism 303, to cause one operation of the tempering mechanism 351 (if included), and to cause delivery of one fully completed and tempered coil spring by the delivery mechanism 321 to the transfer conveyor 121. In normal operation, the main forming machine drive servo-motor 225 is actuated several times, in respective response to an equal number of incremental advancements of the transfer conveyor 121, before full completion and tempering of a coil spring and delivery thereof takes place. However, during normal operation, one coil spring is completed for each incremental advancement of the transfer conveyor 121.

In the embodiment shown in FIG. 2, the control system 135 is operative to automatically and non-selectively cause energization of the conveyor drive servo-motor 155 through one operational cycle in response to completion of one operational cycle of both of the first and second main forming machine drive servo-motors 225 and 226 and is also operative to automatically and non-selectively cause simultaneous energization of the first and second forming machine drive servo-motors 225 and 226 in response to completion of one operational cycle of the conveyor drive servo-motor 155.

In this last regard, the transfer conveyor drive servo-motor 155 is serially and incrementally operated in response to serial completion of coil springs by the coil spring forming machines 113 and 115. In turn, the main forming machine drive servo-motors 225 and 226 of the coil spring forming machines 113 and 115 are actuated or energized to complete full formation, tempering, and delivery to the vertically extending pallets 161 in response to completion of each incremental advance of the transfer conveyor 121. Thus, every time the transfer conveyor 121 completes one incremental advancement, thereby locating one of the platens 161 in a vertical disposition in the loading station 153, the coil spring forming machines 113 and 115 are each energized so as to complete one coil spring and to deliver the completed coil spring to the vertically extending pallet 161 which is then at rest in the loading station 153.

Figure 16:
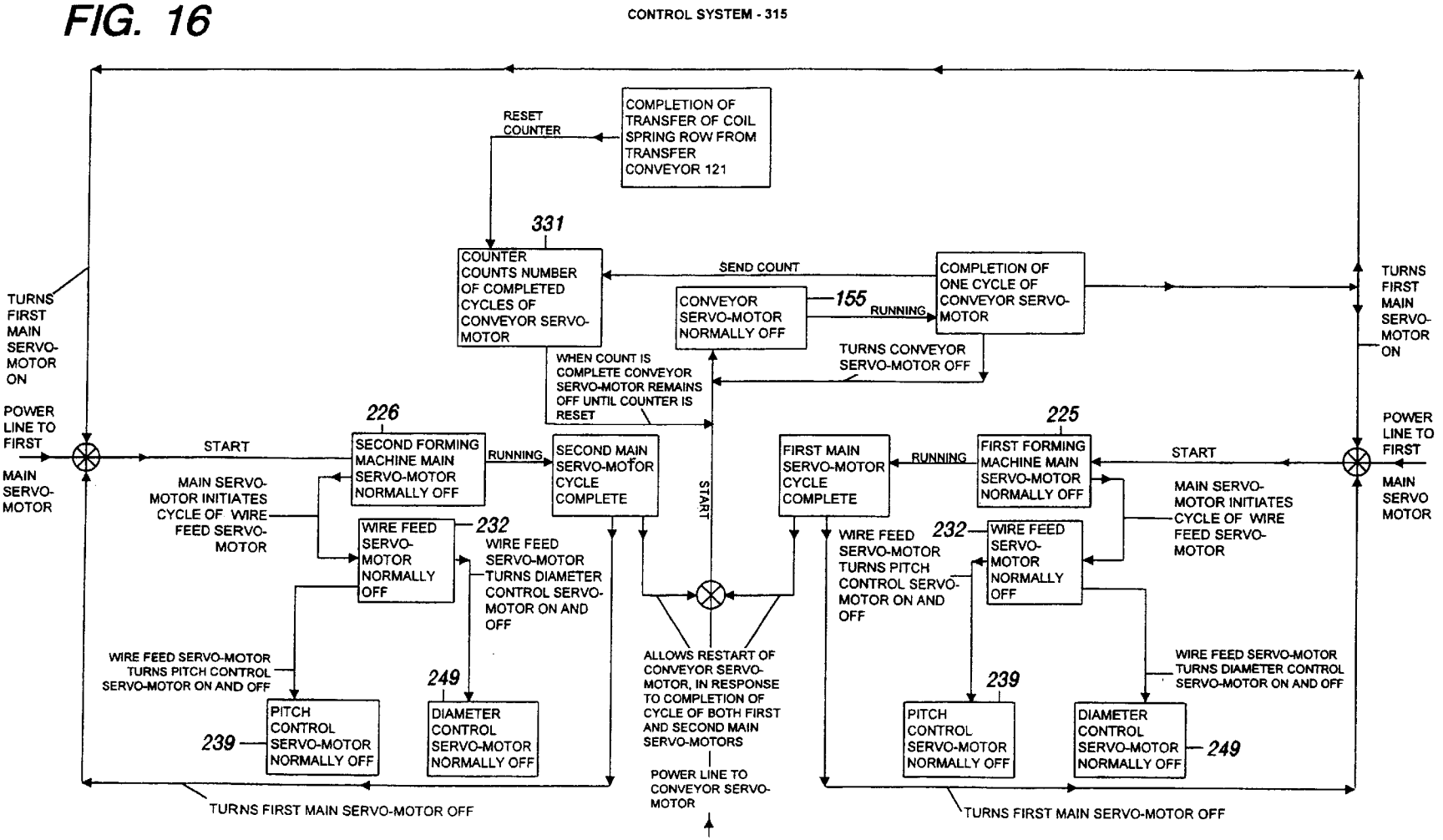
FIG. 16 is a diagrammatic view of one embodiment of a control system incorporated in the machine assembly shown in FIG. 2.

Still more specifically, FIG. 16 illustrates diagrammatically one embodiment of the control system 315. As depicted therein, the conveyor servo-motor 155 and the first and second main forming machine drive servo-motors 225 and 226 are normally off.

The conveyor drive servo-motor 155 can be initially energized by the operator, and thereafter, in response to completion of one operational cycle of the conveyor drive servo-motor 155, the conveyor drive servo-motor 155 is deenergized or turned off and remains turned off until completion of the next cycle of both of the first and second main forming machine servo-motors 225 and 226. In addition, completion of one operational cycle of the conveyor drive servo-motor 155 produces an energizing signal which is sent to both the first and second main forming machine servo-motors 225 and 226, whereby both servo-motors are energized or turned on. Thereafter, upon completion of one operational cycle of both of the first and second main forming machine servo-motors 225 and 226, the first and second forming machine drive servo-motors 225 and 226 are deenergized or turned off and remain turned off until completion of the next cycle of the conveyor drive servo-motor 155. In addition, completion of one operational cycle of both of the first and second main forming machine servo-motors 225 and 226, turns on or restarts the conveyor drive servo-motor 155.

Energization of the main forming machine drive servo-motors 225 and 226 serves also to derivatively energize the wire feed servo-motors 232 for an appropriate period of time to complete one cycle of the wire feed servo-motors 232. In turn, energization of the wire feed servo-motors 232 serves to energize, i.e., to turn on and off, the pitch control and diameter control servo-motors 239 and 249 for an appropriate period of time to complete one cycle of these servo-motors, all within the time period of one operational cycle of the main forming machine drive servo-motors 225 and 226.

The control system 315 also includes a first counter 331 which is adjustable to vary the count and which counts the number of completed operational cycles of the conveyor drive servo-motor 155, (or of one of the main forming machine drive servo-motors 225 and 226). When a predetermined count is reached, i.e., when the desired number of number of coil springs are located on the transfer conveyor 121 in a row adjacent the coil spring transfer apparatus 125, the counter 331 operates to prevent energization or turning on of the main forming machine servo-motors 225 and 226. However, when the transfer of a row of coil springs from the transfer conveyor 121 is completed, the counter 331 is signaled, i.e., is reset, and operates to thereafter permit energization of the main forming machine drive servo-motors 225 and 226. If the count is incomplete, the counter 331 permits the energization of, i.e., the initiation of the next cycle of, the wire feed servo-motors by the main forming machine servo-motors 225 and 226 so as to enable the wire feed servo-motors to feed another predetermined length of wire.

More specifically, in the control system shown in FIG. 16, each complete cycle of the conveyor servo-motor results in the sending of a signal to the counter 331 which, when the count is incomplete, permits initiation of the next cycle of the forming machine main servo-motors 225 and 226. When the count is complete, the counter 331 prevents the next initiation of the cycle of the conveyor servo-motor 155 until reset in response to completion of the transfer of a row of coil springs from the transfer conveyor 121 to the coil spring transfer apparatus 125.

Any suitable construction can be employed to provide the counter 331.

Figure 17:
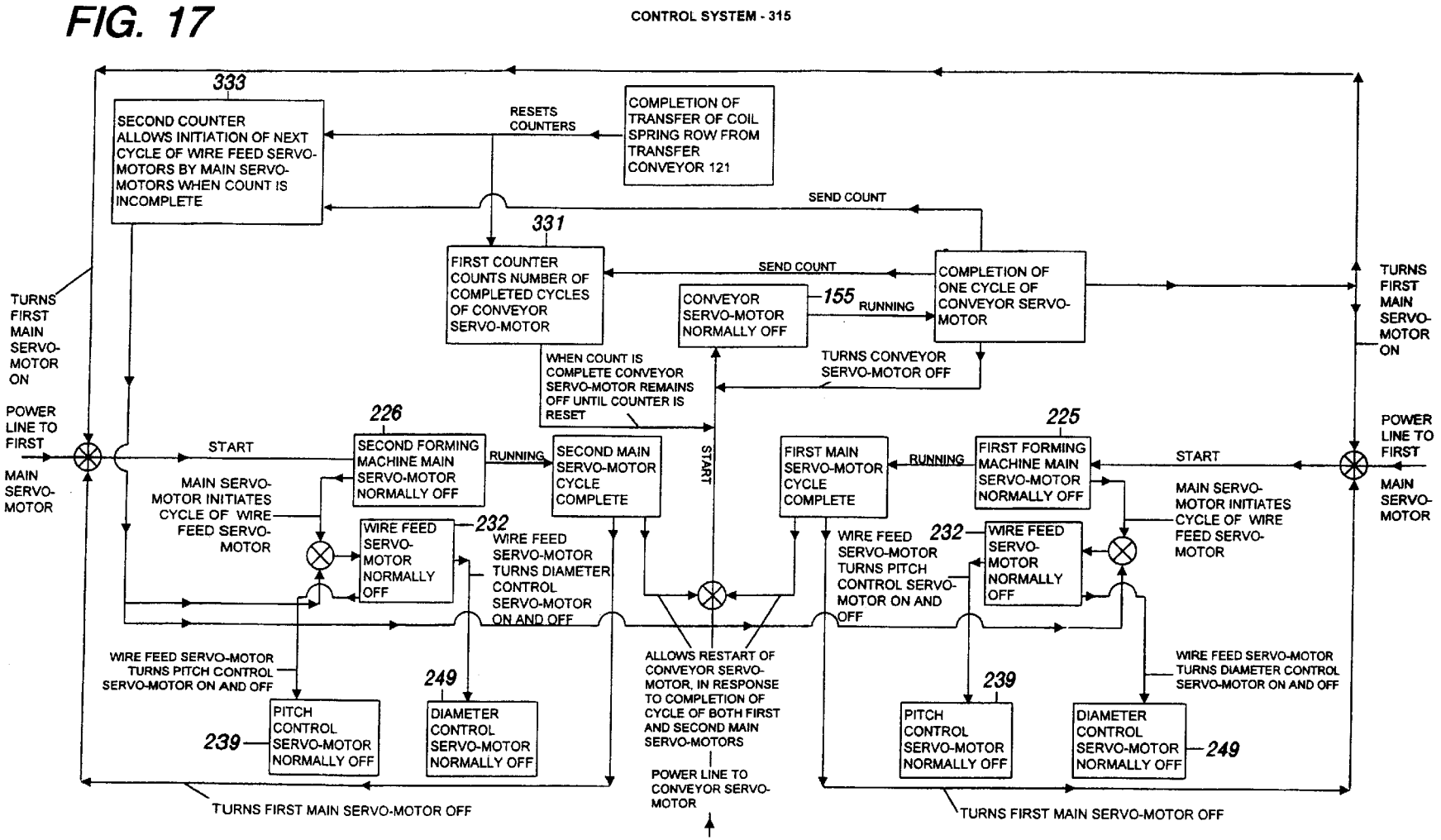
FIG. 17 is a diagrammatic view of a second embodiment of a control system incorporated in the machine assembly shown in FIG. 2.

FIG. 17 illustrates diagrammatically a second embodiment of the control system 315. As depicted therein, the control system 315 is the same as that shown in FIG. 16, except that an additional counter 333 also serves to control energization of, or initiation of the next cycle of, the wire feed servo-motors 232 by the forming machine main servo-motors 225 and 226, i.e., when the count at the counter 331 is incomplete, initiation of the next cycle of the wire feed servo-motors 232 by the forming machine main servo-motors 225 and 226 is allowed by the counter 331. When the count is complete, but the counter 331 has not been reset, energization of the wire feed servo-motors 232 by the forming machine main servo-motors 225 and 226 is prevented. After resetting of the counter 333, the counter 333 sends a signal permitting restarting of the conveyor servo-motor 155.

Any suitable construction can be employed to provide the counter 333.

As a consequence of the operation of the just-described embodiment of the control system 135, each energization of the main forming machine drive servo-motors 225 and 226 of the coil spring forming machines 113 and 115 is dependent on, and occurs only in response to, each succeeding incremental advancement of the transfer conveyor 121, and each energization of the conveyor drive servo-motor 155 (and consequent incremental advancement of the transfer conveyor 121) is dependent on, and occurs only in response to, each preceding completion of one coil spring by each of the coil spring forming machines 113 and 115.

The control system 135 also desirably includes one or more stop functions which is/are operable, in the event of a malfunction, such as the absence of a coil spring on one of the pallets 161 of the transfer conveyor 121, to disable further operation of the conveyor drive servo-motor 155 and the main forming machine drive servo-motors 225 and 226.

In operation of the machine assembly 111 as thus far disclosed, the conveyor drive servo-motor 155 is periodically and incrementally operated to move the transfer conveyor 121 through such distance as will locate the pallet 161 in a vertical orientation. Thereafter, and as a consequence of completion of the incremental movement of the transfer conveyor 121, the coil spring forming machines 113 and 115 are operated to respectively produce and deliver a coil spring to the vertically extending pallet 161. Thereafter, the conveyor drive servo-motor 155 is again energized to again advance the transfer conveyor 121 though the given incremental distance which is approximately equal to the length of the pallets 161 in the direction of conveyor advance.

In operation of the embodiment shown in FIG. 2, the machine assembly 111 is energized to cause each of the coil spring forming machines 113 and 115 to simultaneously deliver a coil spring to the one of the pallets 161 which is vertically extending during non-movement of the transfer conveyor 121. As a consequence, each pallet 161 receives two coil springs in side-by-side relation, and in slightly spaced relation in the direction of conveyor travel, with one of the coil springs desirably being of left-handed construction, and with the other of the coil springs desirably being of right-handed construction. If desired, both coil springs could be of the same hand.

In another embodiment which includes only a single coil spring forming machine which directly supplies fully formed coil springs to the transfer conveyor 121, i.e., the spring assembly machine 111 shown in FIG. 1 with only one coil spring forming machine, the control system 315 is operative to automatically and non-selectively cause energization of the conveyor drive servo-motor 155 in response to completion of one operational cycle of the main forming machine drive servo-motor 255, and, thereafter, is operative to automatically and non-selectively cause energization of the main forming machine drive servo-motor 225 in response to completion of one operational cycle of the conveyor drive servo-motor 155. Thereafter, completion of one operational cycle of the main forming machine drive servo-motor 225 causes energization of the conveyor drive servo-motor 155 to provide one incremental advance of the transfer conveyor 121, and so on.

Figure 6:
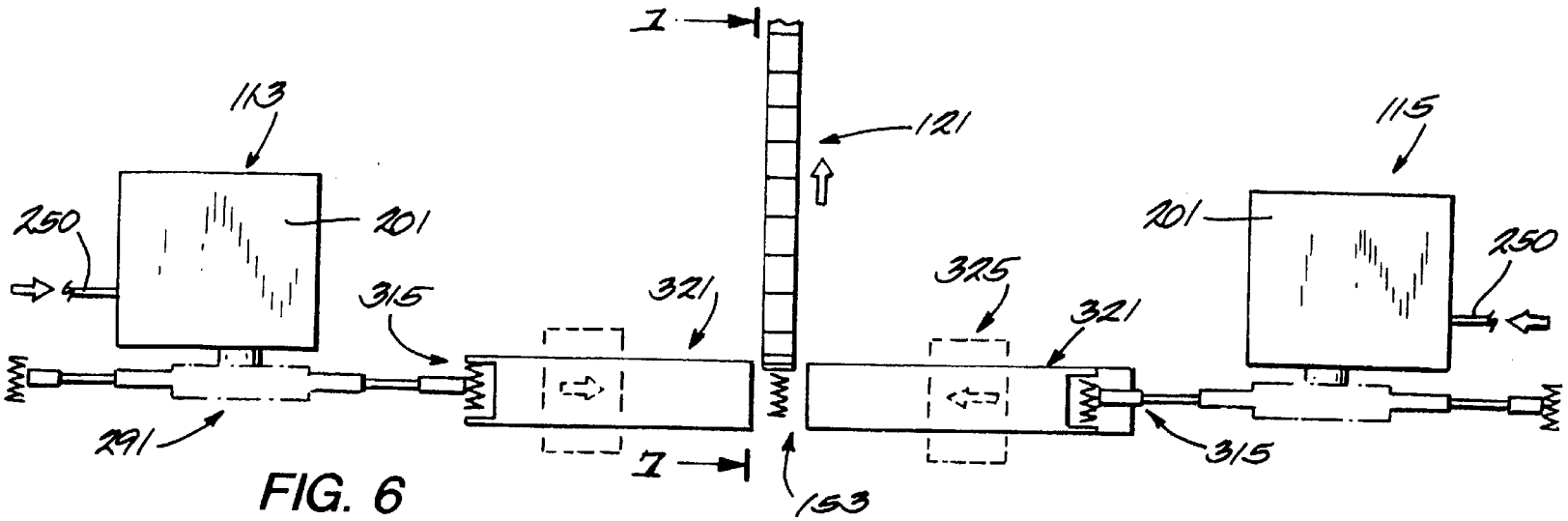
FIG. 6 is a top plan schematic view of a portion of a second embodiment of a coil spring forming and assembling machine which embodies various of the features of the invention.
Figure 18:
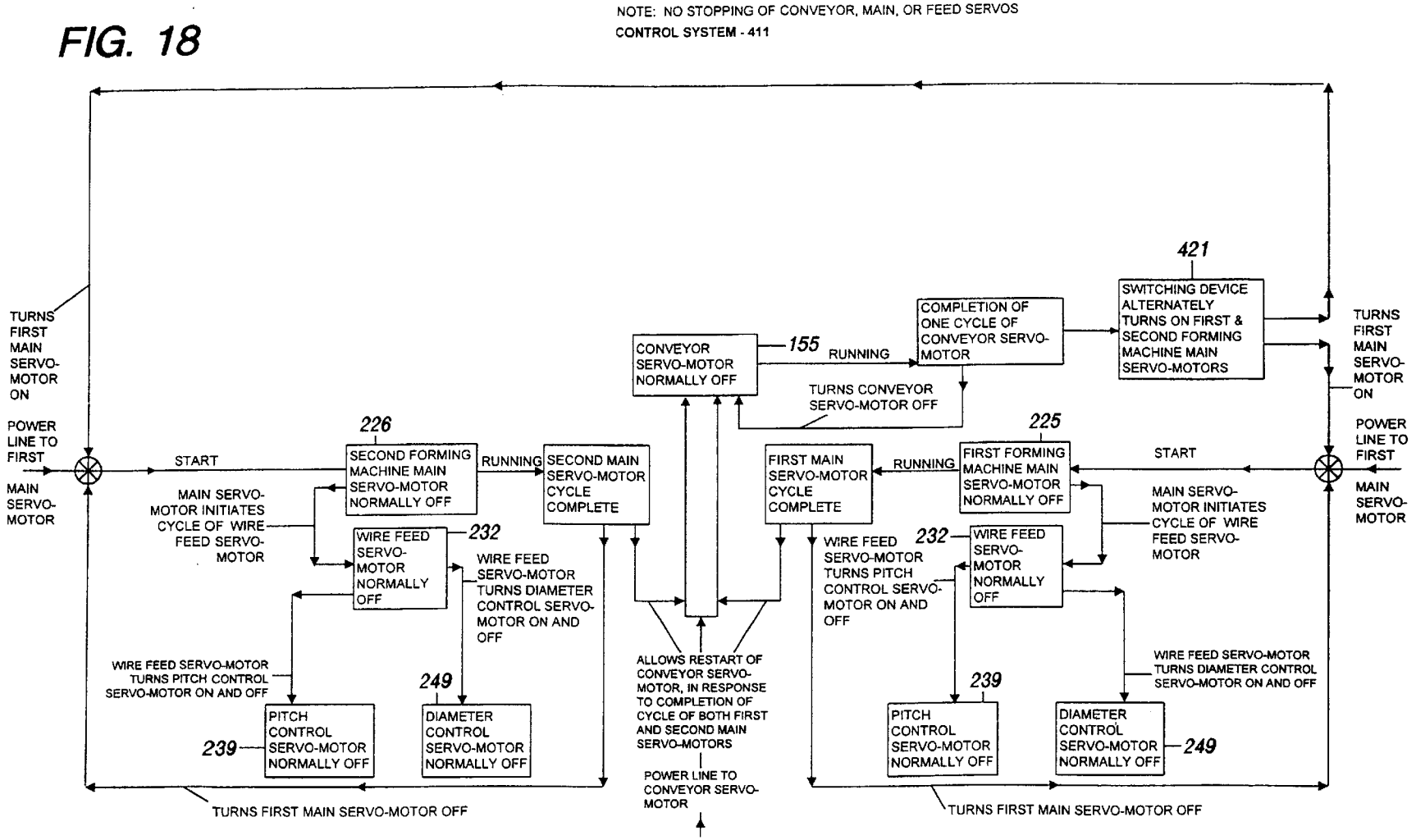
FIG. 18 is a diagrammatic view of one embodiment of a control system incorporated in the machine assembly shown in FIG. 6.

More particularly in the this regard, shown schematically in FIG. 18 is a control system 411 for the machine assembly shown in FIG. 6. The control system 411 is generally identical to the control system 315 shown in FIG. 16, except that the counter 331 is omitted, and except that the signal generated in response to completion of one cycle of the conveyor servo-motor 155 causes a switching device 421 to alternately energize the first and second main forming machine drive servo-motors 225 and 226. In addition, as distinguished from the control systems 315 shown in FIGS. 16 and 17, the conveyor servo-motor 155 can be energized by a signal from either of the forming machine main servo-motors 225 and 226. Thus, after completion of a first cycle of the conveyor drive servo-motor 155, one of the first servo-motors 225 and 226 is energized or turned on, while the other one of the forming machine drive servo-motors 225 and 226 remains deenergized, and then, after completion of the next cycle of the conveyer drive servo-motor 155, the other one of the servo-motors 225 and 226 is energized or turned on, while the first mentioned one of the servo-motors 225 and 226 remains deenergized.

Any suitable construction can be employed to provide the switching device 421.

In addition, the control system 411 of FIG. 18 differs from the control system 315 of FIG. 16 in that the power line to the conveyor drive servo-motor 155 includes first and second parallel branches 427 and 429 which are respectively connected to the lines which carry the signals indicating completion of the operational cycles of the first and second main forming machine drive servo-motors 225 and 226. Thus, whenever the operational cycle of one of the main forming machine drive servo-motors 225 and 226 is completed, the conveyor drive servo-motor 155 is again energized or turned on.

In the embodiment shown in FIG. 6, the control system 135 (a) is operative to automatically and non-selectively cause energization of the conveyor drive servo-motor through a first operational cycle in response to completion of one operational cycle of the second main forming machine drive servo-motor 226, (b) is operative to automatically and non-selectively cause energization of the first main forming machine drive servo-motor 225 in response to completion of the first operational cycle of the conveyor drive servo-motor 155, (c) is operative to automatically and non-selectively cause energization of the conveyor drive servo-motor 155 through a second operational cycle in response to completion of one operational cycle of the first main forming machine drive servo-motor 225, (d) is operative to automatically and non-selectively cause energization of the second main forming machine drive servo-motor 226 in response to completion of the second operational cycle of the conveyor drive servo-motor 155.

Thus, in operation of the embodiment shown in FIG. 6, the main forming machine drive servo-motors 225 and 226 are alternately energized to cause the coil spring forming machines 113 and 115 to alternately deliver completed coil springs to the transfer conveyor 121. More specifically, the machine assembly is arranged so that, initially, one of the coil forming machines 113 and 115 delivers one end convolution of a coil spring into the pocket 170 of one pallet 161 when the one pallet is located in vertically extending orientation in the loading station 153 during non-movement of the transfer conveyor 121. Thereafter, the transfer conveyor 121 is advanced through one increment of movement approximately equal to the length of one pallet 161 and so as to locate the next one of the pallets 161 in vertically extending orientation in the loading station 153. Thereafter, the other of the coil spring forming machines 113 and 115 delivers one end convolution of another coil spring (which is desirably of the other hand) into the pocket 170 of the next pallet 161 when the next pallet 161 is located in vertically extending orientation in the loading station 153 during non-movement of the transfer conveyor 121.

As a consequence, every other pallet 161 receives one coil spring which is desirably of a given hand, i.e., either left- or right-hand, while all of the intermediate pallets 161 receive one coil spring which, desirably, is of the other hand. However if desired, the coil forming machines 113 and 115 could be operated to deliver coils of the same hand to the transfer conveyor.

In another embodiment of the invention which is shown in FIG. 15 and which is otherwise similar to the arrangement shown in FIG. 6, the control system 315 is arranged to afford selective delivery by the coil spring forming machines 113 and 115 to the transfer conveyor 121. This capability permits the formation of coil spring rows (on the transfer conveyor 121) of a selected number of coil springs formed by one of the coil spring forming machines 113 and 115, followed by another selected number of coil springs formed by the other one of the coil spring forming machines 113 and 115. As a consequence, when one of the coil spring forming machines 113 and 115 manufactures coil springs of one selected configuration and the other of the coil spring forming machines 113 and 115 manufactures coil springs of another configuration, spring assemblies can be manufactured with predetermined variations in springiness.

More particularly, the control system 315 can be arranged to include first and second counting and switching devices 413 and 415 which are of any suitable construction, which are respectively connected to the main forming machine drive servo-motors 225 and 226 of the first and second coil spring forming machines 113 and 115, which are connectable to and disconnectable from the conveyor drive servo-motor 155 and which respectively include count adjusting knobs 423 and 425, whereby the number of coil springs to be delivered from either one of the first and second coil spring forming machines 113 and 115 to the transfer conveyor 121, before delivery of coil springs from the other one of the machines to the transfer conveyor 121, can be varied from 0 to X. In the alternative, if desired, the first and second counting and switching devices 413 and 415 can be connected to the conveyor drive servo-motor 155 and can be respectively connectable to and disconnectable from the main forming machine drive servo-motors 225 and 226 of the first and second coil spring forming machines 113 and 115.

In operation of one embodiment, initially, the first and second counting and switching devices 413 and 415 are arranged so that the first counting and switching device 413 is connected to the conveyor drive servo-motor 155, and so that the second counting and switching device 415 is disconnected from the conveyor drive servo-motor 155. When thus arranged, and after manipulation of the adjusting knob 423 of the first counting and switching device 413 to select a desired number of successive operational cycles of the first coil spring forming machine 113, the arrangement is (a) thereafter operative to effect the selected desired number of successive operational cycles of the first coil spring forming machine 113 by successive energization of the main forming machine drive servo-motor 225 of the first coil spring forming machine 113 in response to each successive completion of the selected desired number of operational cycles of the conveyor drive servo-motor 155, and (b) thereafter, and upon completion of the selected desired number of operational cycles of the conveyor drive servo-motor 155, is operable to effect disconnection of the first counting and switching device 413 from the conveyor drive servo-motor 155 and connection of the second counting and switching device 415 to the conveyor drive servo-motor 155.

After such connection and disconnection, the second counting and switching device 415, and assuming that the adjusting knob 425 of the second counting and switching device 415 has been adjusted to select a desired number of successive operational cycles of the second coil spring forming machine 115, the arrangement is (a) thereafter operative to effect the selected desired number of successive operational cycles of the second coil spring forming machine 115 by successive energization of the main forming machine drive servo-motor 226 of the second coil spring forming machine 115 in response to each successive completion of the selected desired number of operational cycles of the conveyor drive servo-motor 155, and (b) thereafter, and upon completion of the selected desired number of operational cycles of the conveyor drive servo-motor 155, is operative to effect disconnection of the second counting and switching device 415 from the conveyor drive servo-motor 155 and re-connection of the first counting and switching device 413 to the conveyor drive servo-motor 155. Thereafter the first counting and switching device 413 operates as described just above.

Because it is believed that anyone skilled in the art can readily construct the control system 135 to obtain the operations disclosed above in detail, description of particular devices and components included in the control system 135 is believed to be unnecessary.

Various of the features of the invention are set forth in the following claims.

What is claimed is:

1. A delivery mechanism for delivering a coil formed by a coil forming machine to a transfer conveyor, wherein the coil includes a non-circular outer peripheral portion, the delivery mechanism comprising:

a delivery portion having a coil receiving end, a delivery end, and spaced apart side walls extending between the receiving end and the delivery end and defining therebetween a coil delivery pathway portion, the coil receiving end including at least one stationary member adjacent at least one of the side walls, wherein the stationary member is configured to engage the non-circular outer peripheral portion of the coil to impart rotation to the coil during travel in the coil delivery pathway portion.

2. The delivery mechanism of claim 1, wherein the stationary member includes a seat portion configured to engage the non-circular outer peripheral portion of the coil.

3. The delivery mechanism of claim 1, wherein a portion of the stationary member defines a pivot point about which the coil pivots during travel in the coil delivery pathway portion.

4. The delivery mechanism of claim 3, wherein the coil is pivoted at least approximately 90 degrees.

5. The delivery mechanism of claim 1, wherein the coil is moveable in the coil delivery pathway portion by means of a moveable member moveable between a retracted position and an advanced position, and wherein the moveable member is engageable with the coil to pivot the coil during movement of the moveable member from the retracted position toward the advanced position.

6. The delivery mechanism of claim 5, wherein the stationary member is located between the retracted position and the advanced position of the moveable member such that the coil is pivoted about the stationary member during movement of the moveable member from the retracted position to the advanced position.

7. The delivery mechanism of claim 1, further including a pusher that moves the coil from the coil receiving end to the coil delivery end.

8. The delivery mechanism of claim 1, further including a moveable member which is moveable between a retracted position, wherein the coil engages the moveable member, and an advanced position, wherein the moveable member places the coil in engagement with the transfer conveyor.

9. A delivery mechanism for delivering a coil formed by a coil spring forming machine to a transfer conveyor, the delivery mechanism comprising:

a delivery portion having a coil receiving end and a delivery end located adjacent the transfer conveyor, a coil supply mechanism for supplying coils one at a time to the coil receiving end, and a moveable member moveable between a retracted position and an advanced position, wherein movement of the moveable member from its retracted position to its advanced position is operable to move the coil from the coil receiving end to the delivery end and to place the coil in engagement with the transfer conveyor.

10. A method of transferring a coil along a coil conveying pathway and in a coil conveying direction from a coil spring forming machine to a transfer conveyor, the method comprising:

placing the coil into a seat associated with the pathway;

stationarily maintaining the coil in engagement with the seat;

rotating the coil while moving the coil out of engagement with the seat, wherein the seat is configured to engage at least a portion of the coil such that movement of the coil away from the seat is operable to rotate the coil;

advancing the coil along the pathway; and transferring the coil from the pathway to the transfer conveyor.

11. The method of claim 10, wherein the pathway includes a delivery portion having a receiving end and a moveable member in the receiving end, the moveable member being moveable between a retracted position and an advanced position, and wherein rotating the coil further includes moving the moveable member from the retracted position toward the advanced position to pivot the coil about the seat.

12. The method of claim 10, wherein rotating the coil includes pivoting the coil at least approximately 90 degrees about the seat.

13. The method of claim 10, wherein advancing the coil includes engaging the coil with a pusher and moving the pusher toward the transfer conveyor.

14. The method of claim 10, wherein the pathway includes a delivery portion having a delivery end and a moveable member in the delivery end, the moveable member being moveable between a retracted position and an advanced position, and wherein transferring the coil from the pathway to the transfer conveyor includes engaging the coil with the moveable member while the moveable member is in the retracted position and moving the moveable member toward the advanced position.

15. A delivery mechanism for delivering a coil formed by a coil forming machine to a transfer mechanism, comprising:

a coil conveying pathway including a coil receiving area and a discharge area, wherein the discharge area is located adjacent the transfer mechanism;

wherein each coil includes at least one non-circular external portion, and wherein the coil receiving area includes a seat configured to receive and engage the non-circular external portion of the coil; and a moveable member for moving each coil away from the coil receiving area in the coil conveying pathway, wherein engagement of the coil with the seat is operable to rotate the coil during movement of the coil away from the coil receiving area by operation of the moveable member.

16. The delivery mechanism of claim 15, wherein the moveable member is moveable between a retracted position and an advanced position, and wherein the moveable member is engageable with the coil at the coil receiving area to rotate the coil during movement of the moveable member from the retracted position toward the advanced position.

17. The delivery mechanism of claim 15, wherein the moveable member is moveable between a retracted position, wherein the moveable member engages the coil in the coil receiving area, and an advanced position, wherein the moveable member pushes the coil within the coil conveying pathway toward the transfer mechanism.

18. A method of transferring a coil from a coil forming machine to a transfer mechanism, comprising the steps of:

moving the coil in a first direction from the coil forming machine into engagement with a stationary member associated with a coil receiving area;

moving the coil in a second direction transverse to the first direction away from the coil receiving area and out of engagement with the stationary member to a coil transfer area, wherein the stationary member is operable to engage the coil such that movement of the coil out of engagement with the stationary member is operable to rotate the coil to a predetermined coil orientation; and supplying the coil to the transfer mechanism from the coil transfer area.

19. A coil transfer arrangement for transferring coils from a coil forming machine to a downstream station, comprising:

an arm mechanism that engages each coil and moves the coil in a first direction away from a coil forming machine to a receiving area;

a moveable member located at the receiving area, wherein the moveable member is moveable from a retracted position to an advanced position, and wherein the moveable member is configured and arranged to engage each coil at the receiving area and to move the coil in a second direction, transverse to the first direction, away from the receiving area to a transfer area; and a transfer mechanism located at the transfer area for receiving coils moved to the transfer area by the moveable member and for moving the coils toward the downstream station.

* * * * *